US005980381A

United States Patent [19]

McCormick

[11] Patent Number: 5,980,381

[45] Date of Patent: Nov. 9, 1999

[54] AIR VENT SYSTEMS AND METHODS

[76] Inventor: Sunny McCormick, 291 Birch Bay Lynden Rd., Lynden, Wash. 98264

[21] Appl. No.: 09/149,529

[22] Filed: Sep. 8, 1998

[51] Int. Cl.[6] ..... F24F 13/10

[52] U.S. Cl. ..... 454/259

[58] Field of Search ..... 454/259, 289, 454/290, 322, 333

[56] References Cited

U.S. PATENT DOCUMENTS

| | | | |
|---|---|---|---|
| 1,975,686 | 10/1934 | Froelich . | |
| 2,074,024 | 3/1937 | Phail . | |
| 2,631,519 | 3/1953 | Sprouse et al. . | |
| 3,143,953 | 8/1964 | Bristol . | |
| 3,926,102 | 12/1975 | DeLepeleire . | |
| 4,108,238 | 8/1978 | Vary et al. | 165/57 |
| 4,394,958 | 7/1983 | Whitney et al. . | |
| 4,452,391 | 6/1984 | Chow . | |
| 4,457,215 | 7/1984 | Vogt . | |
| 5,230,657 | 7/1993 | Opoka | 454/289 |
| 5,674,124 | 10/1997 | Davis | 454/290 |

FOREIGN PATENT DOCUMENTS

| | | | |
|---|---|---|---|
| 59760 | 5/1942 | Denmark | 454/259 |

OTHER PUBLICATIONS

Witten Vent, Gastonia, NC advertisement of Pop–Up Vent.

*Primary Examiner*—Harold Joyce

*Attorney, Agent, or Firm*—Michael R. Schacht; Hughes & Schacht, P.S.

[57] ABSTRACT

A vent assembly for controlling flow of air into a room. The vent assembly comprises a housing and a damper member mounted entirely within the housing. The housing is mounted to a surface of the room such that air passing through an air duct pass through a passageway defined by the housing. Air flowing through the passageway causes the damper member to rotate into an open position; when no air is flowing through the passageway, gravity or another force (such as a return spring) causes the damper member to remain in a closed position. A control member may be provided to allow the damper member to placed into a locked closed configuration, a locked open configuration, or an open configuration.

21 Claims, 18 Drawing Sheets

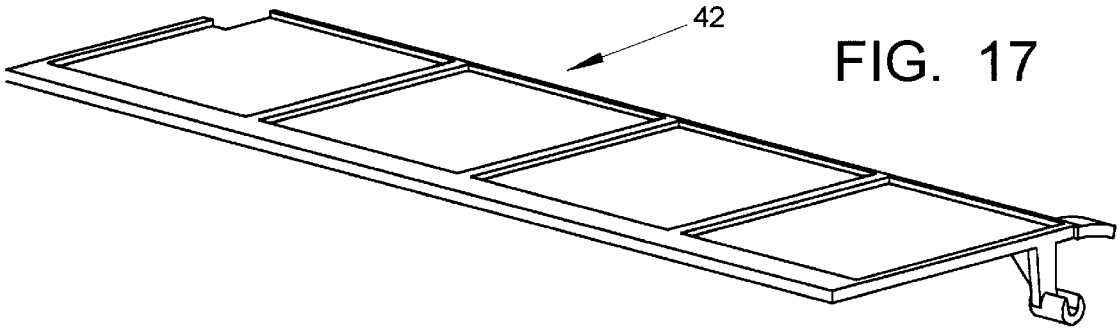
FIG. 17
FIG. 18A
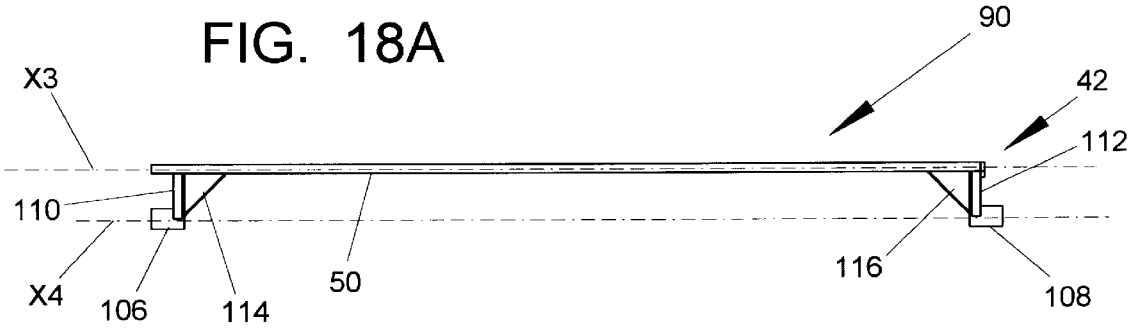
FIG. 18B
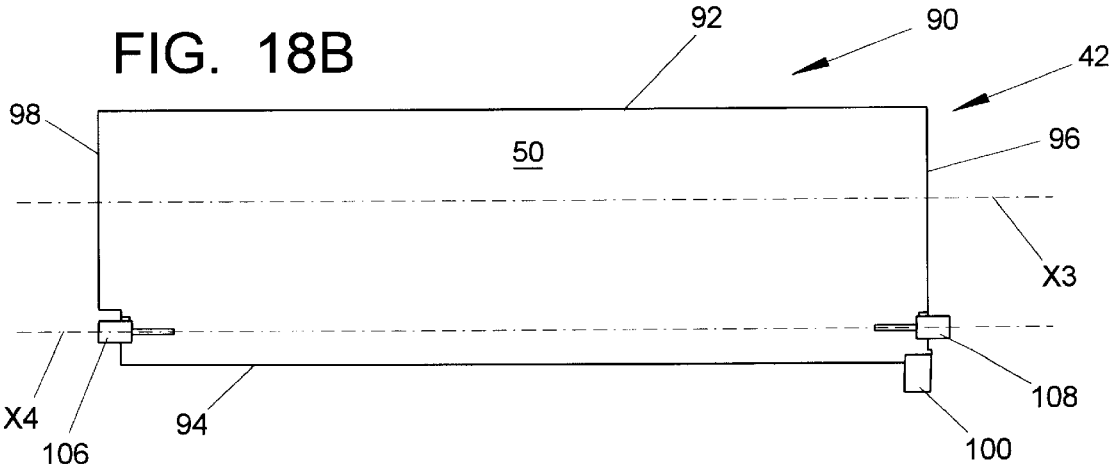

AIR VENT SYSTEMS AND METHODS

TECHNICAL FIELD

The present invention relates to air vents and, in particular, to systems and methods that allow air ducts to closed and/or the direction of forced air leaving these heating ducts to be changed automatically.

BACKGROUND OF THE INVENTION

Buildings are often heated with an air conditioning system comprising a central air conditioning unit and air ducts. The central air conditioning unit cools or heats air at a central location The cooled or heated air is forced through the air ducts from the central location to a plurality of remote locations or rooms. The forced air entering the room or rooms connected to the air conditioning unit cools or heats the room as appropriate.

Often, it is desirable to prevent forced air traveling through the air ducts from entering a given room connected to the heating system. This may be because the room is unoccupied or the occupants do not, for some other reason, wish that the forced air enter the room.

Usually, forced air is prevented from entering a particular room by an air vent assembly attached to the air duct servicing that particular room. The air vent assembly normally comprises a housing that engages the air duct and one or more louvers mounted on the housing such that the louvers rotate between an open position and a closed position. A mechanical lever or wheel is usually connected to the louvers to allow the operator of the room to open or close the air vent assembly as desired.

The present invention relates to air vent assemblies that are adapted to be mounted in an air duct located in the floor of the room being serviced. The air vent assembly is thus mounted within the heating duct with an upper portion of the housing flush with the floor of the room. The louvers are mounted to the frame below floor of the room, and the control lever or wheel extends slightly above upper portion of the frame to allow access by the operator. A grate is usually mounted to the top of the housing so that the air vent assembly may be walked on.

Once a conventional floor-mounted air vent assembly is placed in its open configuration, it remains there until it is moved into its closed configuration. Thus, dust, dirt, and the like is allowed to enter the air duct when the air vent assembly is in its open configuration and forced air is not flowing through the air duct.

In addition, because the air duct is mounted in the floor, forced air flowing from through the vent assembly tends to flow straight up as it enters the room. Allowing the air to travel straight up as it enters the room is inefficient because the lower, occupied portion of the room is heated last as the air circulates up and along the ceiling before it flows down to warm the lower portion of the room. And because hot air tends to rise anyway, allowing the forced air to travel upwards as it enters the room also works against efficient heating of the lower portion of the room.

In many situations the air duct is located at the outer periphery of the room such that the forced air travels upwards along a window or door. Heat energy carried by the air may thus be transferred out of the room through the window or door, which wastes this heat energy.

Conventional air vent assemblies are thus designed simply to open or close the air duct and do not direct the forced air to one side or the other as the forced air enters the room.

Typically, an air vent deflector is mounted on top of a conventional air vent assembly to direct forced air to the side as the forced air exits the air duct through the air vent assembly. The deflector thus deflects the forced air such that it does not travel straight up; instead, the air is directed towards the interior of the room where it can more efficiently heat the lower portion thereof. Forced air so directed is also less likely to flow along a window or the like where heat energy may be lost.

Conventional air vent deflectors are usually a curved molded plastic part designed to engage the frame of the air vent assembly. The deflector member will typically extend from three to six inches above the floor surface. The deflector member thus forms an obstruction for people walking within the room or other items within the room such as curtains and the like. In addition, such deflectors extending above the level of the floor can break when stepped upon or when hit with a vacuum cleaner.

The need thus exists for improved air vent assemblies and/or air vent deflectors.

RELATED ART

A professional patentability search conducted on behalf of the Applicant turned up the following U.S. Patents that have been classified in one of two groups. The first group relates to air vents that are used in home heating systems. The second group more broadly includes air valves, shutters, and the like that are used in more complex heating, ventilating, and air conditioning systems and are cited herein simply as background information.

The first group of patents includes the following U.S. Patents.

U.S. Pat. No. 4,452,391 to Chow describes a device that includes a damper member that is mounted below floor level and which is normally held open. When the damper is released, the air flow causes the damper to move into a closed position. The damper member does not direct the forced air flowing out of the air duct.

U.S. Pat. No. 4,457,215 to Vogt and U.S. Pat. No. 5,230,657 to Opoka employ air flow to open a heating vent. Both of these devices are opened by air pressure and will also function to direct air towards the center of the room. But much of these devices are located above floor level and thus, as with the air vent deflectors described above, unacceptably intrude into the living space.

U.S. Pat. No. 1975,686 to Froelich discloses a spring loaded holder for a sheet material that covers a heating grate. Air flowing through the grate lifts the sheet material and flows into the area to be heated. The holder simply holds one edge of the sheet material so that it effectively pivots when air flows out of the grate.

U.S. Pat. No. 5,674,124 to Davis and U.S. Pat. No. 4,394,958 to Whitney et al. disclose fairly complicated structures that have at least portions that extend substantially above floor level during use.

The following patents fall in the second group of patents uncovered in the search and are less relevant than those described above; the patents in this second group will be described herein only briefly.

U.S. Pat. No. 4,108,238 to Vary et al. discloses what in affect is a check valve to prevent backflow of cold air into a heating system. U.S. Pat. No. 3,926,102 to DeLepeleire patent discloses an air injecting apparatus that allows an orifice dimensioned to be controlled to control uncomfortable drafts that might occur in an air conditioner or the like.

U.S. Pat. No. 3,143,953 to Bristol discloses a roof ventilator that allows air to be discharged upwardly but which closes to prevent entry of snow and the like. U.S. Pat. No. 2,631,519 to Sprouse et al. discloses a fan with an automatic shutter assembly that opens when the fan is operating but is spring loaded to shut when the fan is not operating. U.S. Pat. No. 2,074,024 to Phail discloses a device that allows air to flow between two rooms to eliminate an unbalance of air pressure in the two rooms.

In addition, the Applicant is aware of a vent available on the market from Witten Vent of Gastonia, N.C., as the POP-UP VENT; this product employs a pop-up, built-in deflector member. The deflector member moves between a down position in which it is substantially flush with the floor surface and an up position in which it extends up above the floor surface. The deflector member poses obstruction problems when it is in its up position. In addition, this unit does not automatically open with the air flow, but instead must be manually put in and out of a pop-up position.

OBJECTS OF THE INVENTION

From the foregoing, it should be clear that one primary object of the present invention is to provide improved air vent systems and methods.

Another more specific object of the present invention is to obtain improved air vent systems and methods that obtain a favorable mix of the following characteristics:

- selectively allows or prevents the flow of forced air within an air duct into a room serviced by that duct;
- directs forced air flowing out of a duct towards the center of the room;
- does not remain in a open configuration when forced air is not flowing through the air duct;
- does not extend significantly above the surface of the floor on which it is mounted;
- is relatively small and simple to use and install;
- can be made in colors, textures, and materials that are aesthetically pleasing;
- can be manufactured and sold relatively inexpensively; and
- all or portions of the unit can be manufactured using sheet metal.

SUMMARY OF THE INVENTION

These and other objects are obtained by the present invention, which is an air vent system comprising a housing assembly that is adapted to be mounted flush with a floor surface and a damper member mounted within the housing assembly such that it is rotatable between opened and closed positions. The damper member is mounted within the housing assembly such that it is entirely below floor level when in either the opened or closed positions and such that gravity holds the damper member in the closed position when forced air is not flowing through the air vent assembly. But forced air flowing through the air vent assembly acts on the damper member to rotate the damper member out of its closed position and into the open position. The damper member must thus be made light and have sufficient surface area for the forced air to rotate it into the open position against the force of gravity.

When the damper member is in its open position, it is angled with respect to vertical such that forced air acting thereon is redirected to one side as it exits the air vent assembly.

The air vent assembly of the present invention may further comprise a control member that engages the damper member to put the assembly in one of three configurations. In an open configuration, the damper member is free to rotate between its opened and closed positions. In a locked closed position, the control member acts on the damper member to prevent it from rotating out of the closed position. In a locked open position, the control member acts on the damper member to prevent it from rotating out of the open position. The control member is accessible by the user such that the user can select one of the three configurations as appropriate.

The housing assembly preferably comprises a frame portion that is mounted within an air vent and a grate portion that is attached to the top of the frame portion such that it is substantially flush with the floor surface in which the air vent terminates. The use of a separate grate member allows a single frame member to be manufactured and sold with great numbers of different materials, textures, and colors. In addition, the grate member may incorporate a system that releases a scent into the air as air flows therethrough.

An air vent assembly as described above achieves the objects of the invention set forth above.

BRIEF DESCRIPTION OF THE DRAWINGS

FIG. 17 is a perspective view of a damper member used by the air vent assembly of FIG. 1;

FIGS. 18*a–e* are front/rear elevation, bottom plan, top plan, right side elevation, and right side elevation views of the damper member of FIG. 17;

DETAILED DESCRIPTION OF THE PREFERRED EMBODIMENTS

Figure 1:
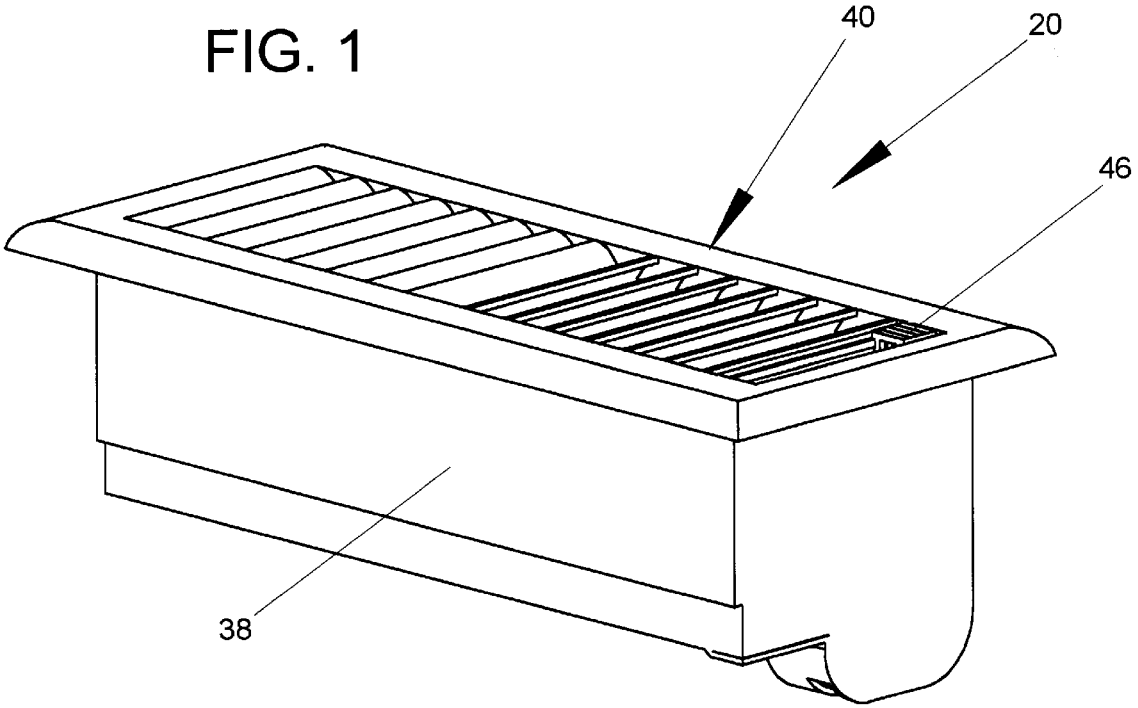
FIG. 1 is a perspective view of an air vent assembly constructed in accordance with, and embodying, the principles of the present invention.

Referring initially to FIGS. 1–5, depicted therein is an air vent assembly 20 that may be embodied as a system or method constructed in accordance with, and embodying, the principles of the present invention. The assembly 20 is typically mounted in an air vent 22 that defines a vent passageway 24 through which forced air passes into an interior 26 of a room serviced by the air duct 22. The duct 22 is further secured to a floor 28 having a surface 30. The duct 22 and floor 28 are conventional and will not be described herein in detail.

Figure 2:
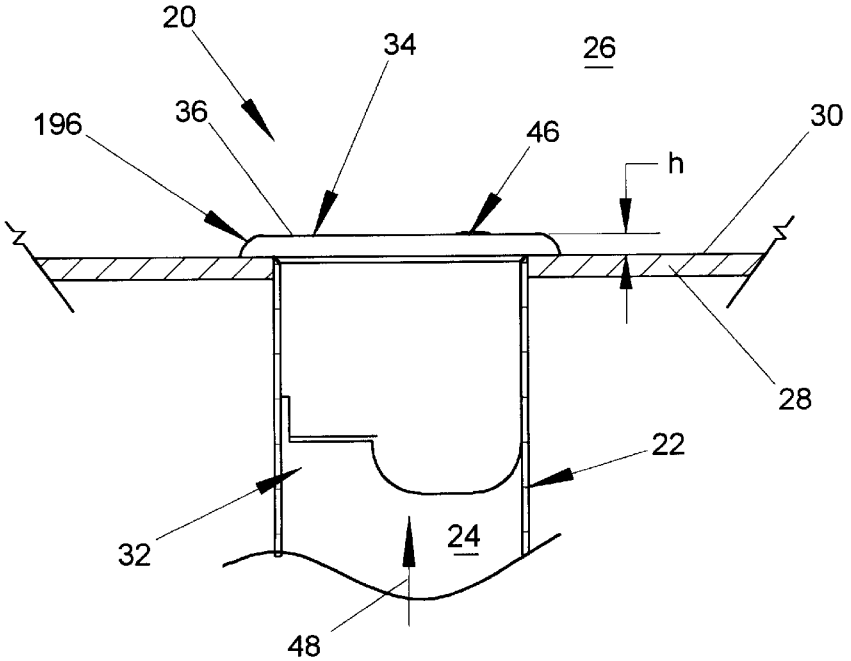
FIG. 2 is an end elevational view showing the air vent assembly of FIG. 1 as it will typical be installed in an air vent.
Figure 3:
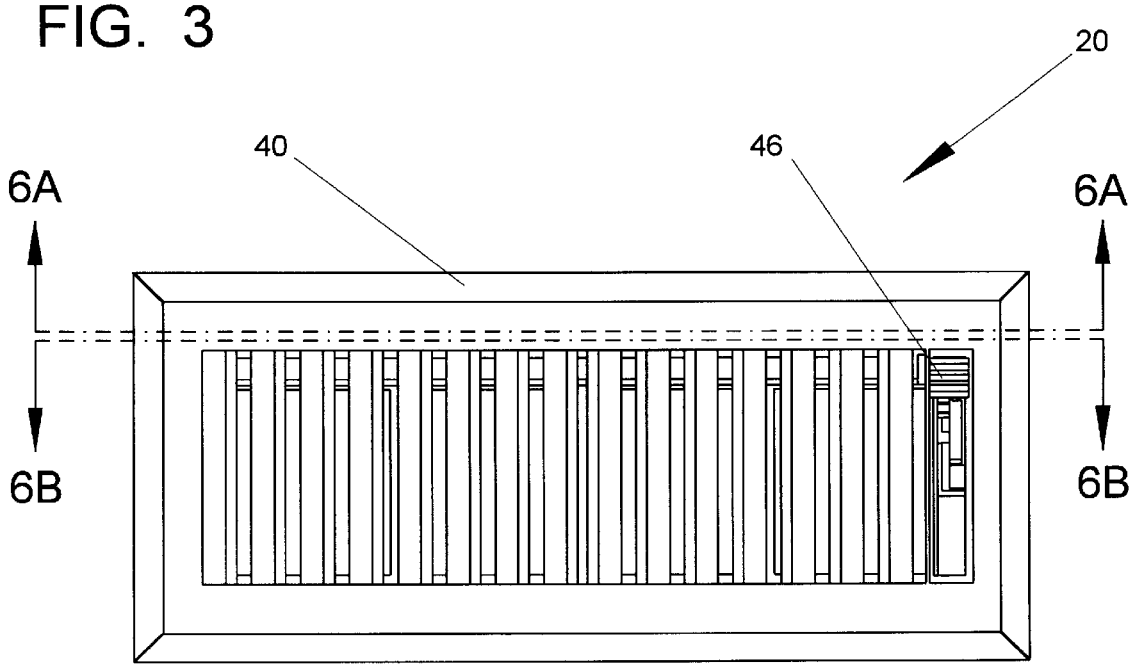
FIG. 3 is a top plan view of the assembly shown in FIG. 1.
Figure 4:
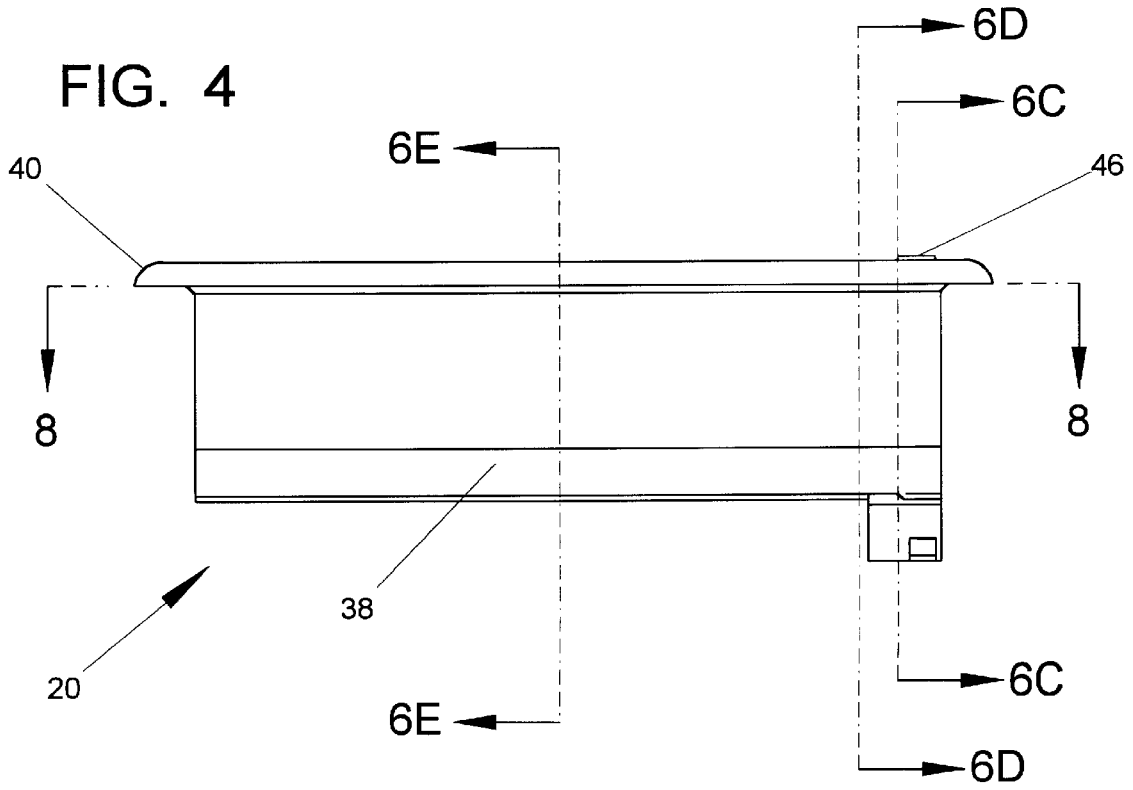
FIG. 4 is a side elevational view of the air vent assembly of FIG. 1.

FIG. 2 shows that the air vent assembly 20 has a lower portion 32 that fits within the air vent 22 and an upper portion 34 that is attached to the lower portion 32 such that the upper portion 34 is substantially flush with the floor surface 30. In the context of the present application, the term "substantially flush" means that an upper surface 36 of the upper portion 34 extends above the floor surface 30 a distance h that is preferably approximately 0.30" and in any event is not greater than approximately 0.60".

Referring now for a moment to FIGS. 5*a–d*, it can be seen that the vent assembly 20 comprises a frame member 38 that forms the lower portion 32, a grate member 40 that forms the upper portion 34, a damper member 42 and control member 44 that are mounted within the frame member 38, and a slide member 46 that is mounted on the grate member 40 such that the slide member 46 engages the control member 44.

The air vent assembly 20 operates basically as follows. The air vent assembly 20 is depicted in its open mode in FIGS. 5*b* and 5*c*. Generally speaking, this open mode is the most common mode in which the assembly 20 operates. In this open mode, the damper member 42 is free to rotate between a closed position as depicted in FIG. 5*c* and an opened position as depicted in FIG. 5*b*.

Figure 5A:
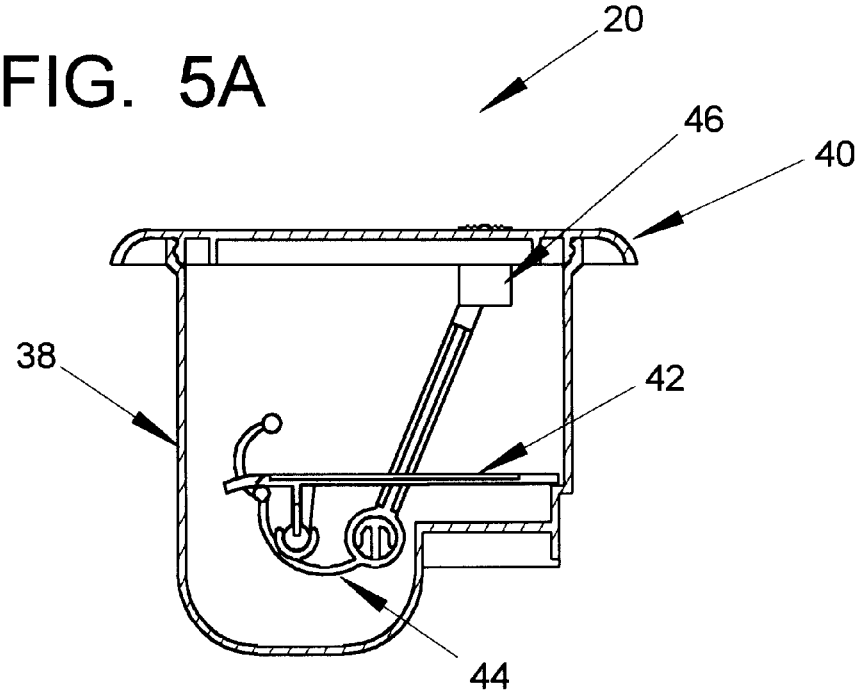
FIGS. 5*a–d* are cut-away views depicting the interaction of the control member and damper member of the air vent assembly of FIG. 1 in a locked closed configuration unlocked, opened configuration unlocked closed configuration, and locked opened configuration.
Figure 5B:
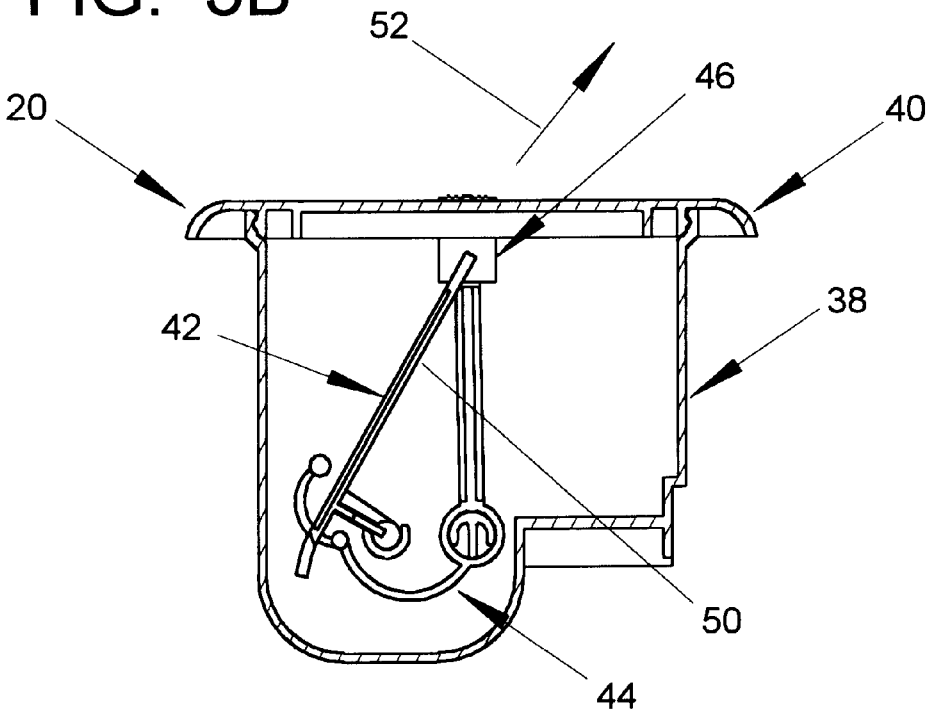
Figure 5C:
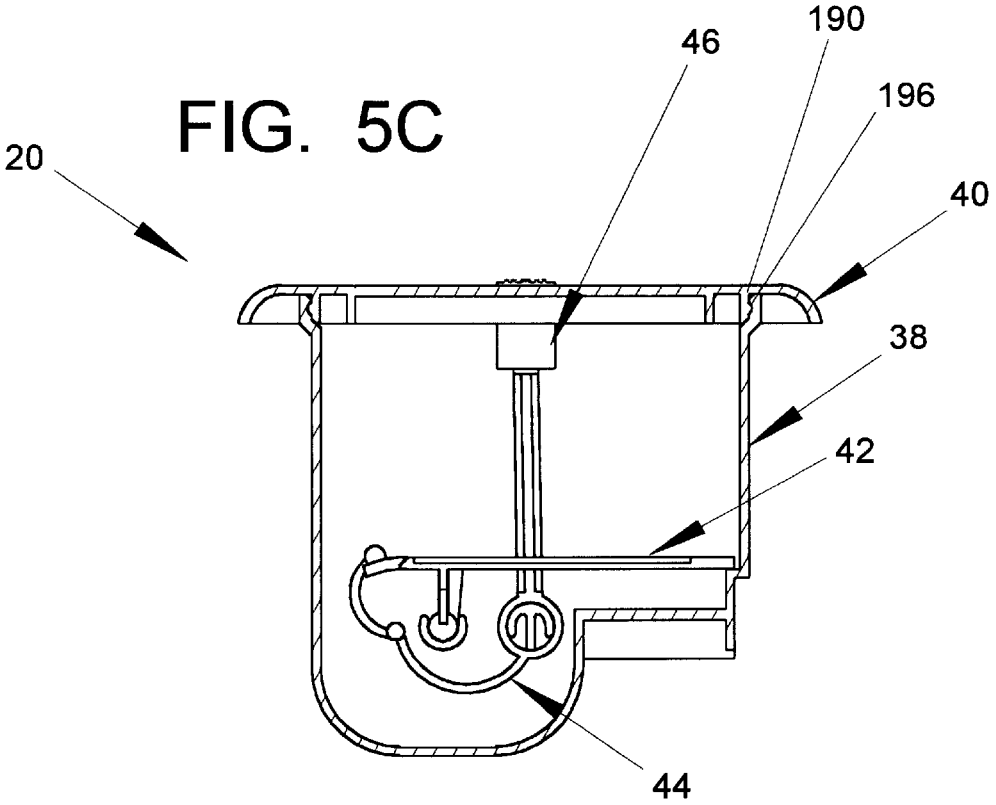

When the damper member 42 is in its closed position as shown in FIG. 5*c*, dirt, dust, and other debris is prevented from entering the air vent 22 through the air vent assembly 20. Forced air flowing in the direction shown by arrow 48 in FIG. 2 will act on a damper surface 50 of the damper member 42 to cause the damper member 42 to rotate into the open position of FIG. 5*b*. In this open position, forced air flowing through the vent 22 in the direction shown by arrow 48 is directed from a vertical path to a directed path as shown by arrow 52 in FIG. 5*b*. The forced air thus does not flow directly to the top of the room as it leaves the vent assembly 20, but rather is directed such that its direction of travel has a substantial sideways component as it leaves the vent assembly 20.

When the damper member 42 is in the locked closed position as shown in FIG. 5*a*, the control member 44 engages the damper member 42 such that the damper member 42 is maintained in its closed position.

Figure 5D:
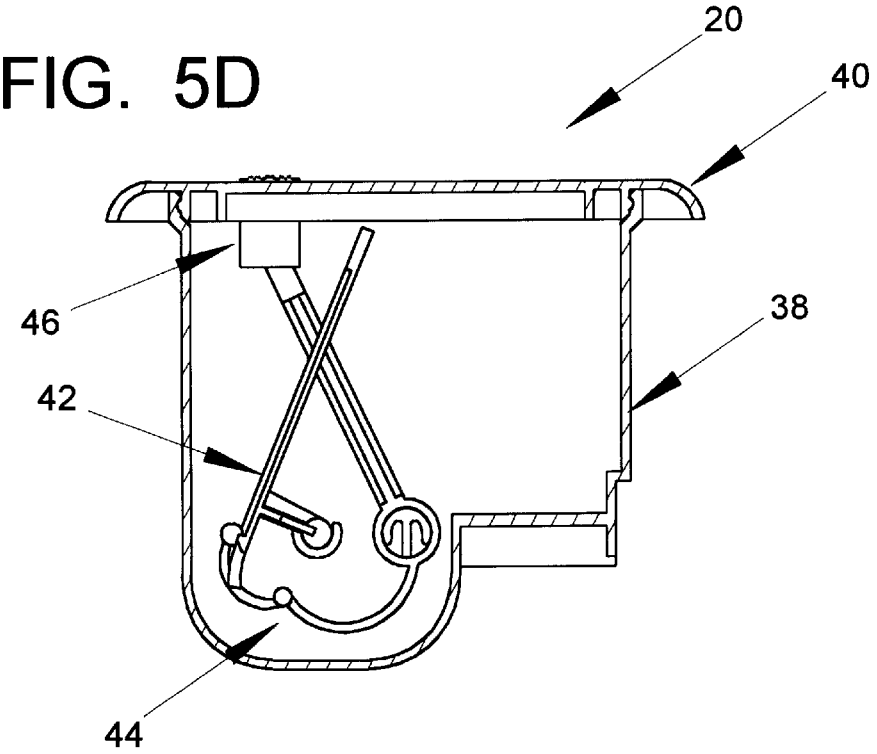
Figure 6A:
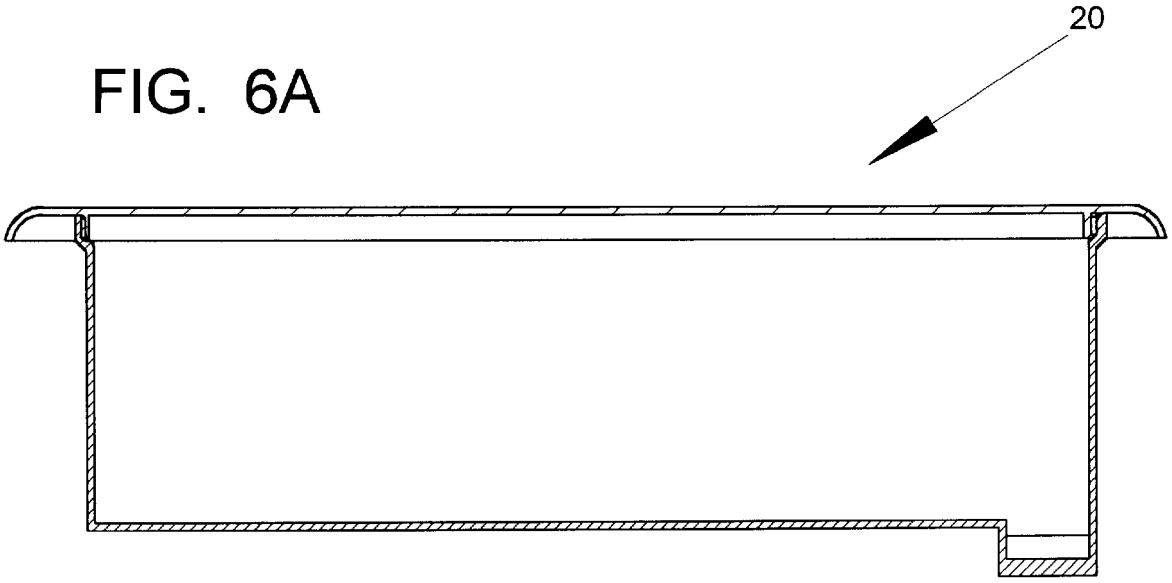
FIG. 6*a* is a section view taken along lines A—A in FIG. 3.
Figure 6B:
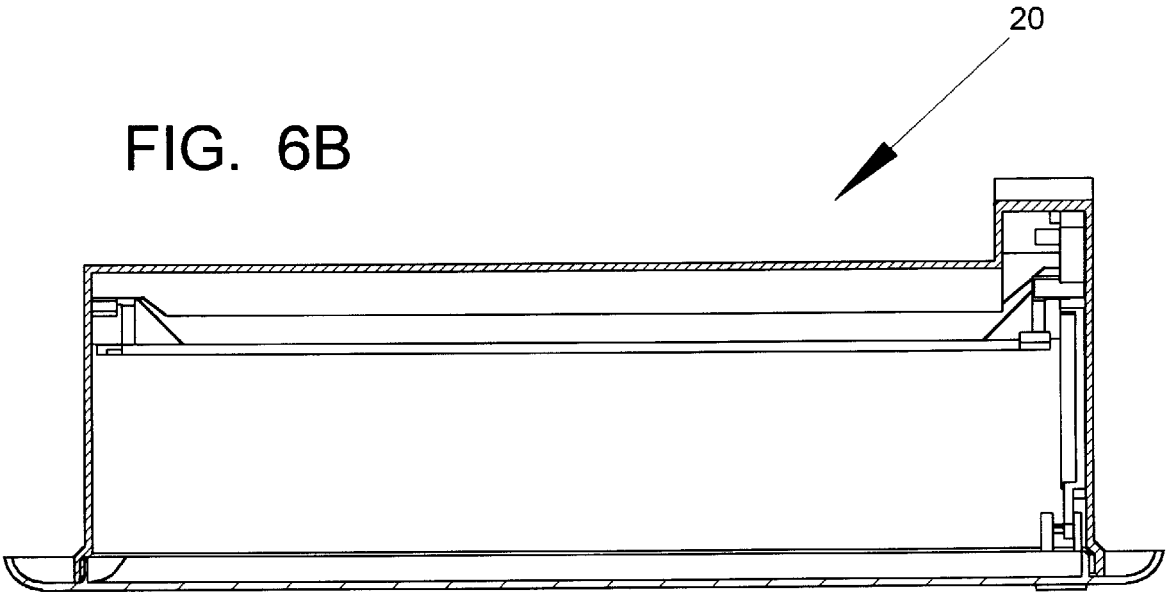
FIG. 6*b* is a section view taken along lines B—B in FIG. 3
Figure 6C:
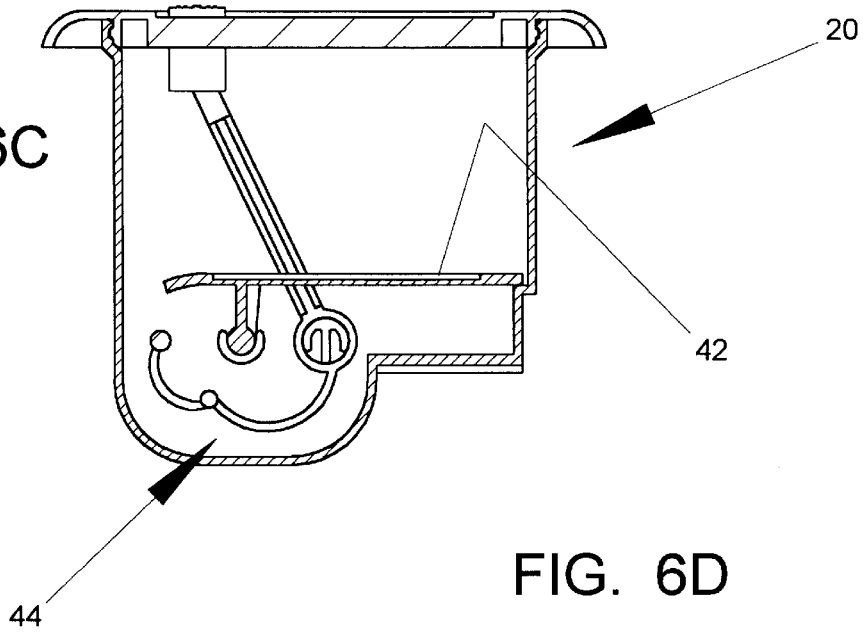
FIG. 6*c* is a section view taken along lines C—C in FIG. 4.
Figure 6D:
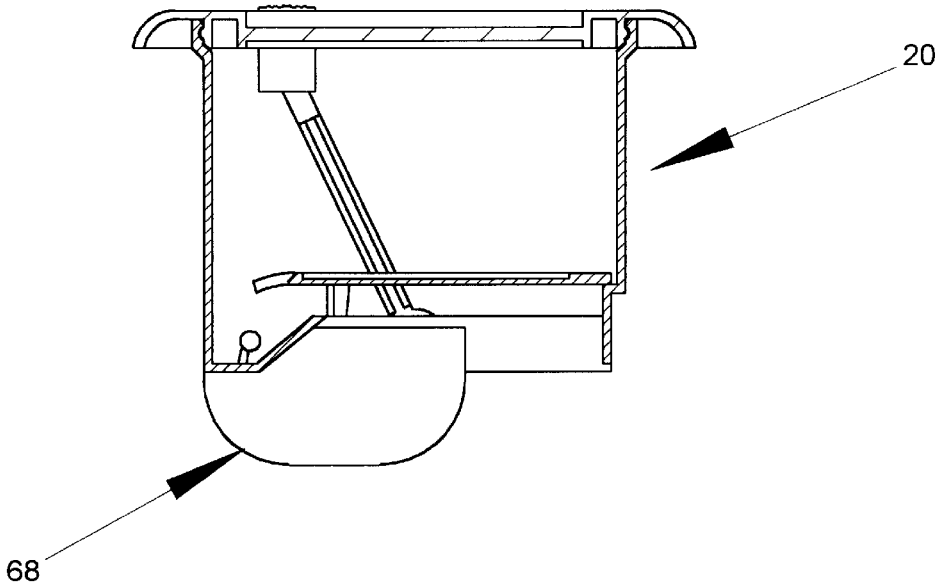
FIG. 6*d* is a section view taken along lines D—D in FIG. 4.
Figure 6E:
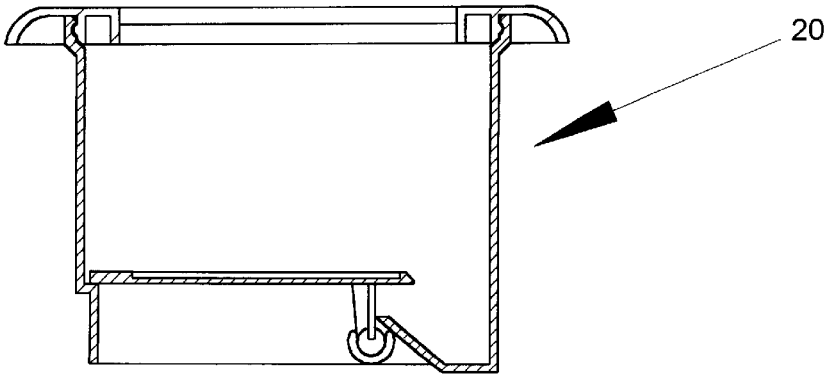
FIG. 6*e* is a section view taken along lines E—E in FIG. 4.

Similarly, when the assembly 20 is in its locked opened position, the control member 44 engages the damper member 42 such that the damper member 42 cannot rotate out of the open position as shown in FIG. 5*d*.

The vent assembly 20 is thus a very simple assembly comprising five parts that can easily be made by injection molding and which gives the user significant flexibility when and how air flows into the room interior 26. With the foregoing basic understanding of the operation of the vent assembly 20 in mind, the construction and operation of this assembly 20 will now be described in further detail.

Figure 11:
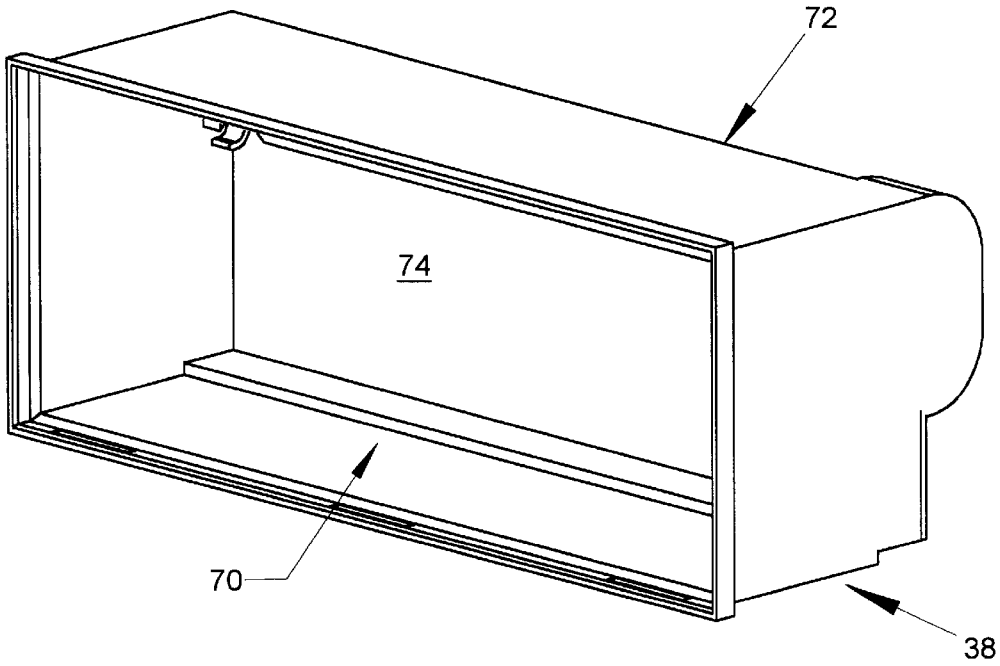
FIG. 11 is a perspective view of a frame member of the air vent assembly of FIG. 1.
Figure 12A:
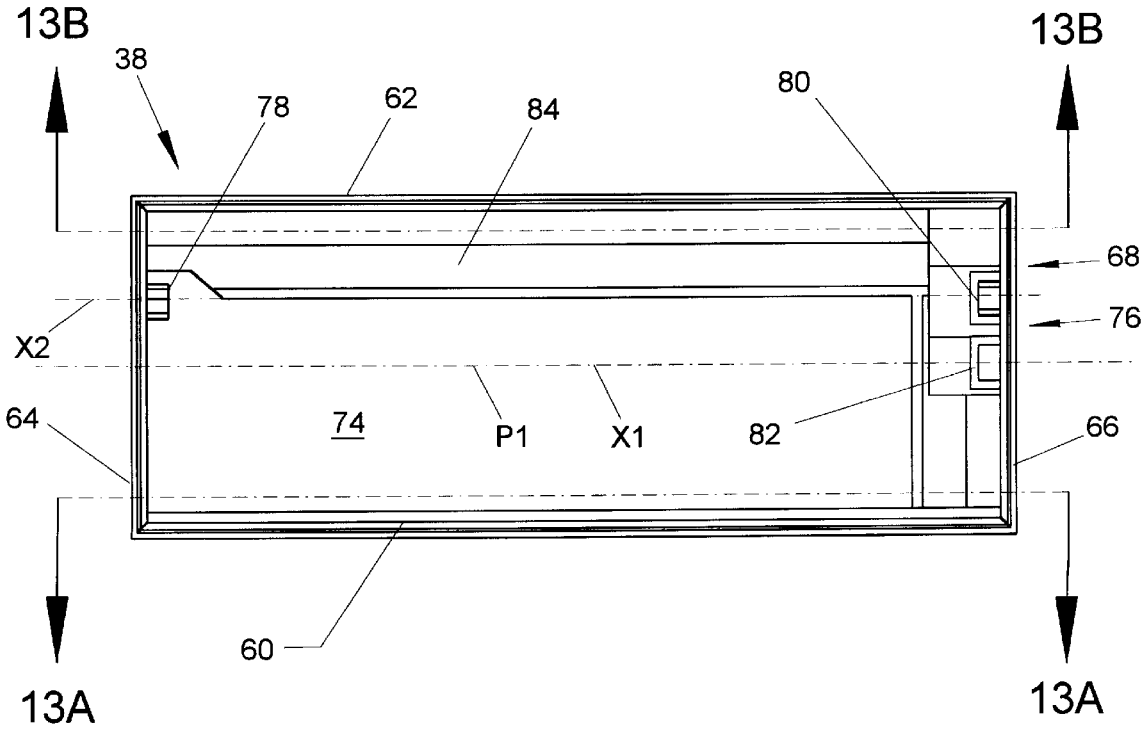
FIGS. 12*a–e* are top plan, front elevation, rear elevation, right side elevation, and left side elevation views of the member depicted in FIG. 11.
Figure 12B:
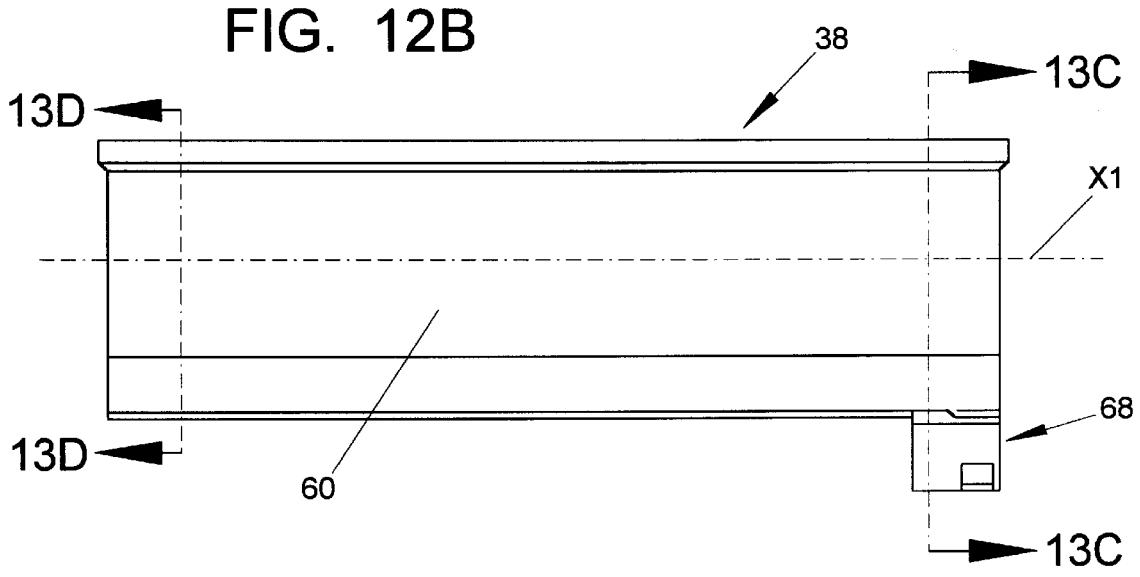
Figure 12C:
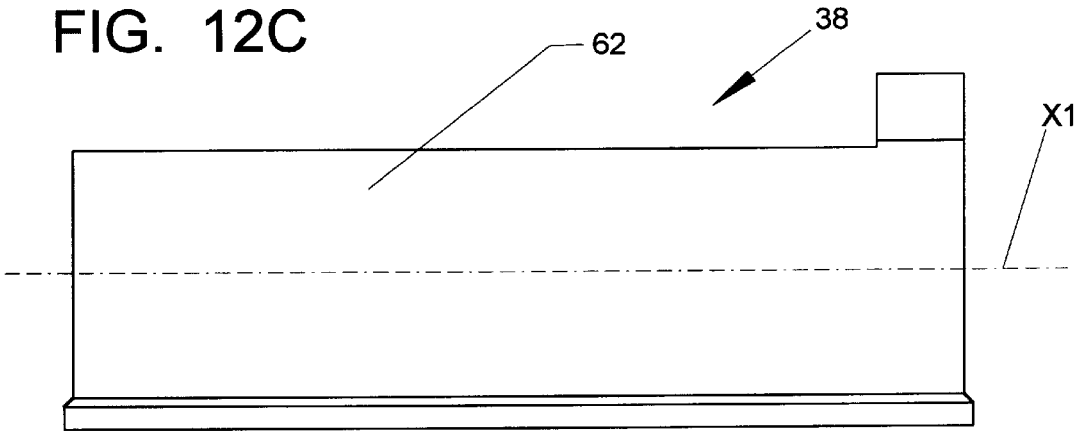
Figure 12D:
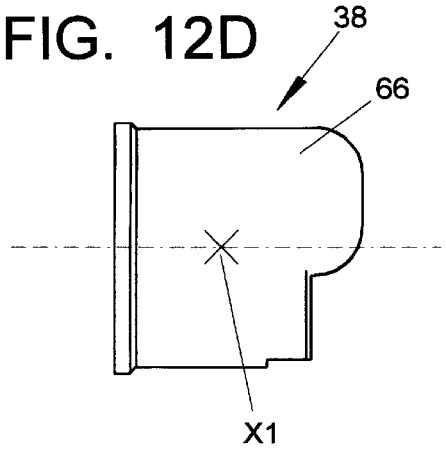
Figure 12E:
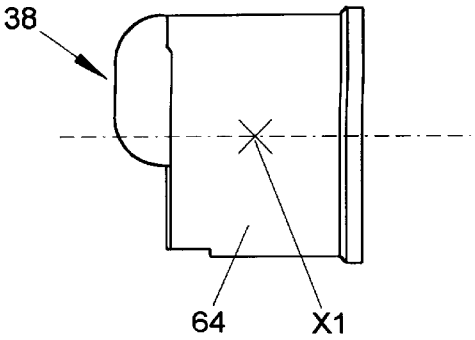
Figure 13A:
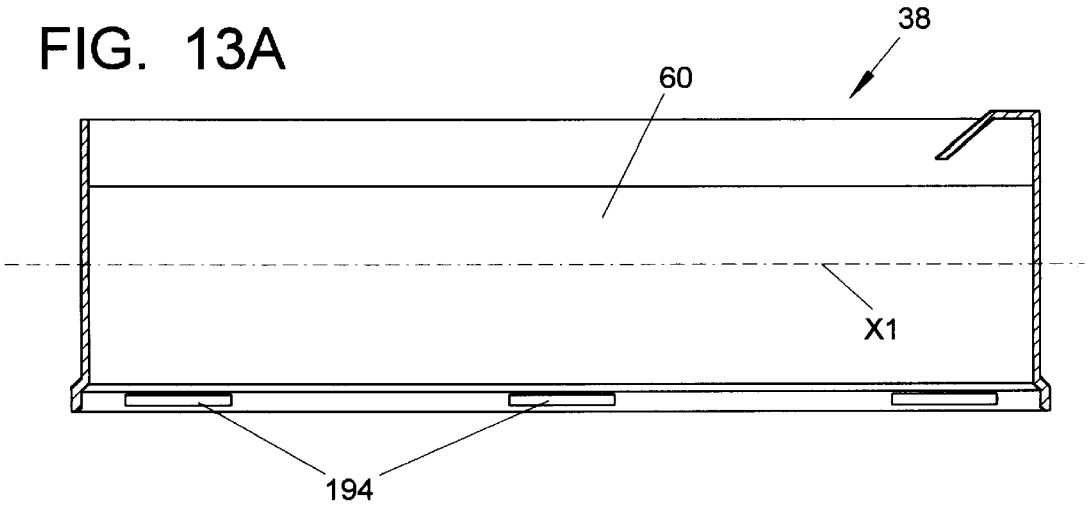
FIG. 13*a* is a cut-away view taken along lines C—C in FIG. 12*a*.
Figure 13B:
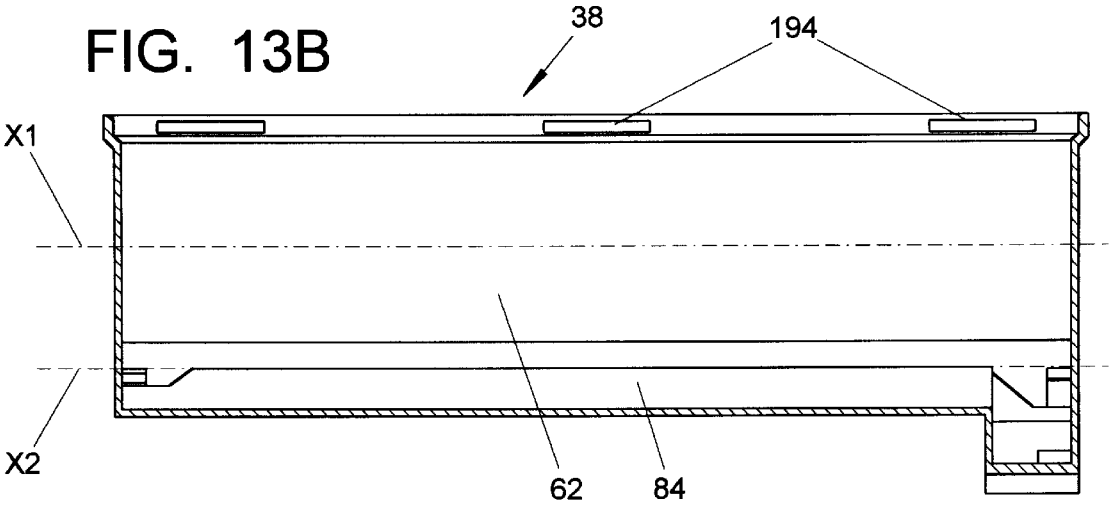
FIG. 13*b* is a section view taken along lines D—D in FIG. 12*a*.
Figure 13C:
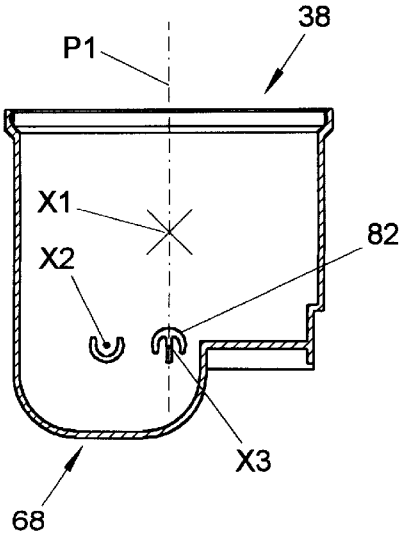
FIG. 13*c* is a section view taken along lines A—A in FIG. 12*b*.
Figure 13D:
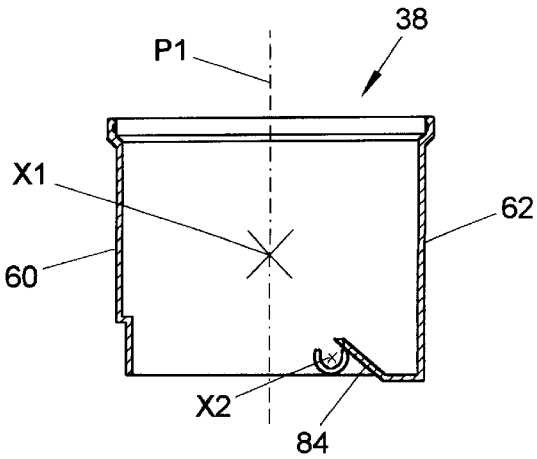
FIG. 13*d* is a section view taken along lines B—B in FIG. 12*b*.

Referring now to FIGS. 11–13, depicted therein is the frame member 38. These figures show that the frame member 38 comprises front and back side walls 60 and 62, left and right end walls 64 and 66, and a control housing 68. The walls 60–66 are joined together to form a substantially rectangular box having an upper opening 70 and a lower opening 62. These walls 60–66 further define a housing passageway 74 that allows fluid communication between the upper and lower openings 70 and 72.

The front and rear side walls 60 and 62 are substantially parallel to each other, and a housing reference plane $p_1$ is defined as a plane that is parallel to and equidistant from the walls 60 and 62. A longitudinal housing axis $x_1$ is defined as a line within the reference plane $p_1$ that extends substantially through the center of the frame member 38. When the air vent assembly 20 is installed, the housing reference plane $p_1$ will be substantially vertically aligned with the upper opening 70 arranged near the floor surface 30 and the lower opening 72 extending within the vent 22.

An attachment system 76 is used to attach the damper member 42 to the frame member 38. The attachment system 76 comprises first and second pivot cups 78 and 80 attached to the end walls 64 and 66, respectively. The pivot cups 76 and 78 are arranged along a cup axis $x_2$.

Also attached to the right end wall 66 is a control projection 82. The control member 44 is attached to this control projection 82 as will be described in further detail below.

The control housing 68 is adapted to surround the control member 44; the details of construction of the control housing 68 are not critical as long as this housing does not interfere with installation or removal of the air vent assembly 20 and allows the control member 44 to move within its full range of movement. The control housing 68 prevents forced air from flowing from the lower opening 72 to the upper opening 70 around the control member 44 when the damper member 42 is in its closed position.

The frame member 38 further comprises a deflecting surface 84 that extends into the housing passageway 74 at an angle relative to the housing reference plane $p_1$. Forced air entering the passageway 74 through the bottom opening 72 along the rear wall 62 will thus be deflected towards the front wall 60.

Figure 14:
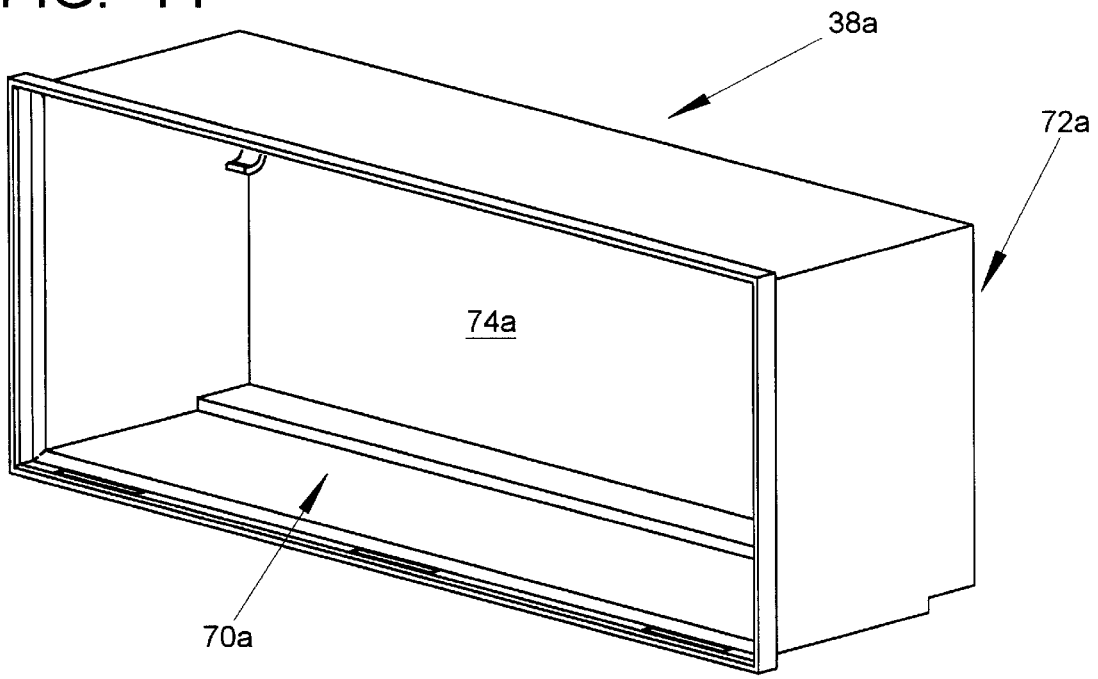
FIG. 14 is a perspective view of an alternative embodiment of a frame member that could be used in the assembly of FIG. 1.
Figure 15A:
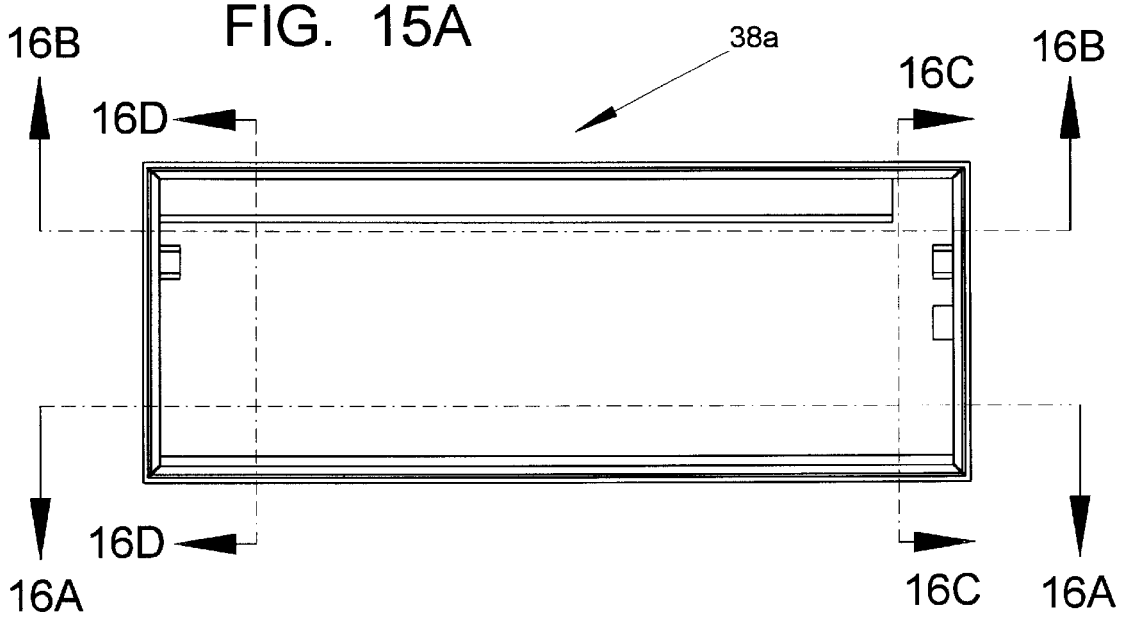
FIGS. 15*a–c* are top plan, front/rear elevation, and end elevation views of the member of FIG. 14.
Figure 15B:
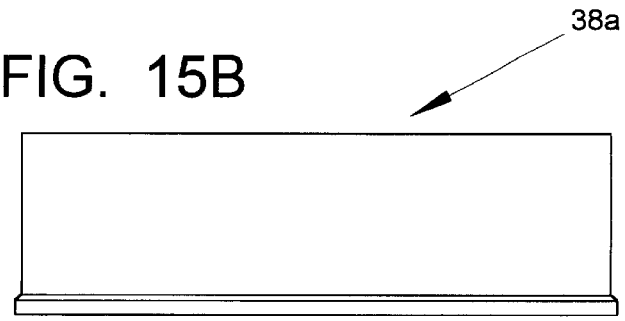
Figure 15C:
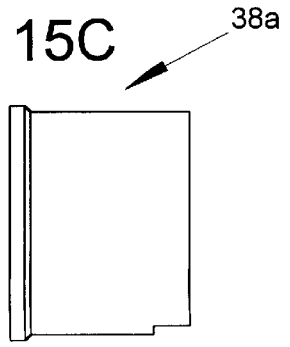
Figure 16A:
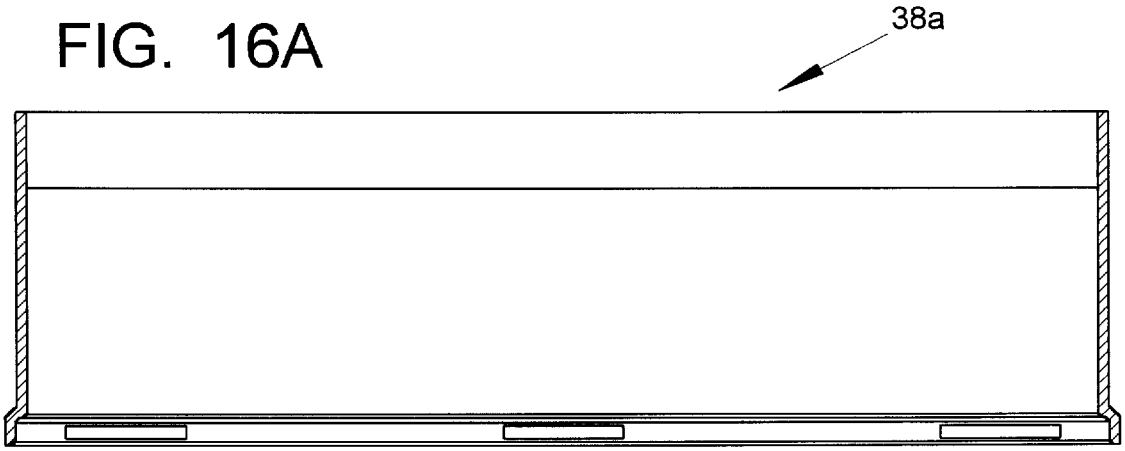
FIG. 16*a* is a section view taken along lines C—C in FIG. 15*a*.
Figure 16B:
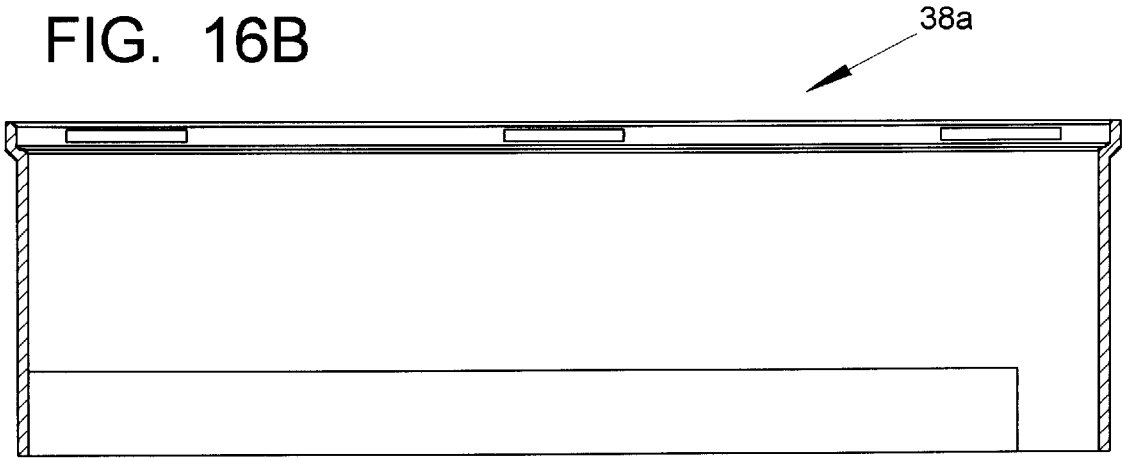
FIG. 16*b* is a section view taken along lines D—D in FIG. 15*a*.
Figure 16C:
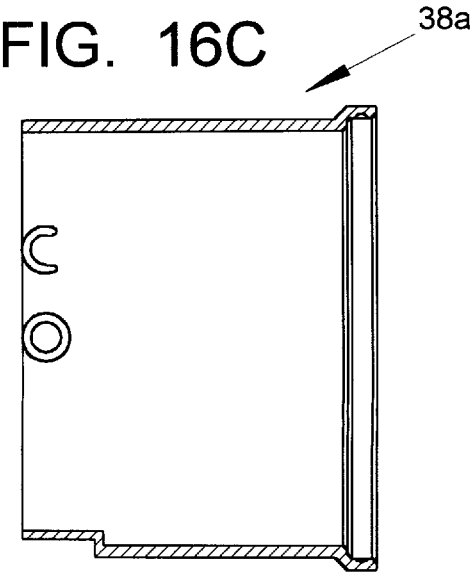
FIG. 16*c* is a section view taken along lines A—A in FIG. 15*a*.
Figure 16D:
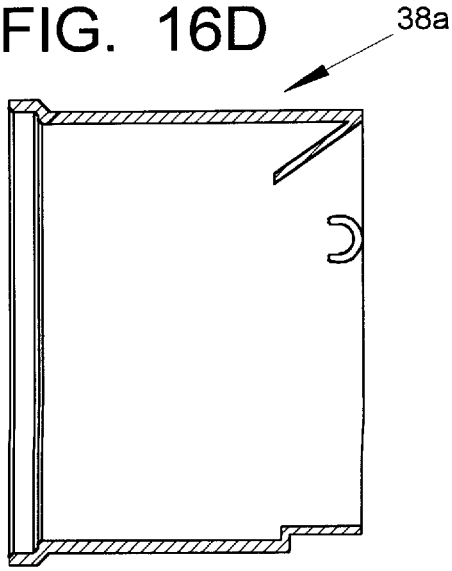
FIG. 16*d* is a section view taken along lines B—B in FIG. 15*a*.

Referring now to FIGS. 14–16, depicted therein is another exemplary frame member 38*a* that may be used in place of the frame member 38 described above. The frame member 38*a* is the same in all respects as the frame member 38 but does not include a control housing such as the control housing 68 described above. The frame member 38*a* will thus function in the same basic manner as the frame member 38 but does not prevent air from flowing through the passageway 74*a* from the lower opening 72*a* to the upper opening 70*a* around the control member 44.

Figure 18C:
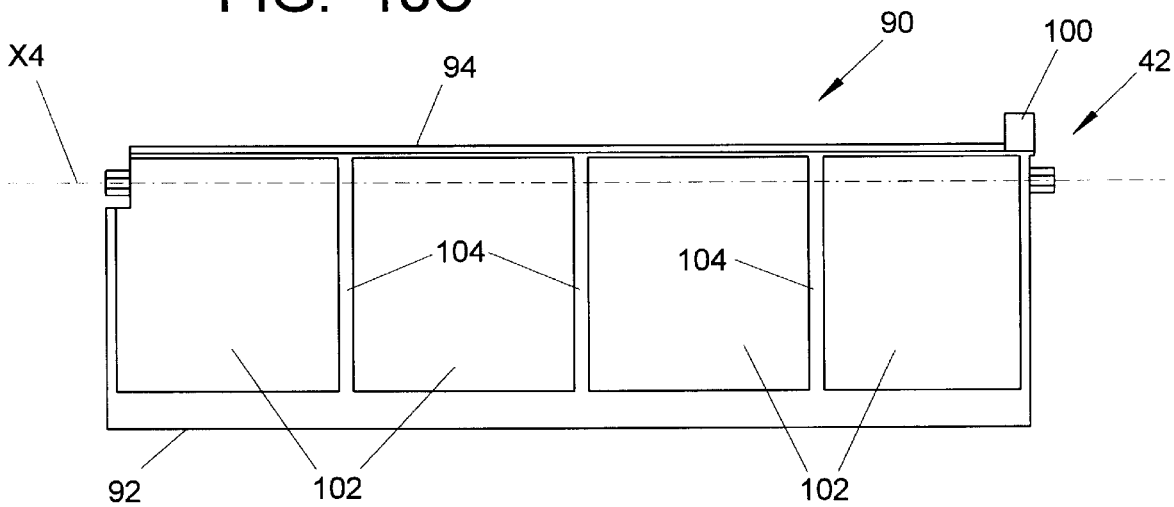
Figure 18D:
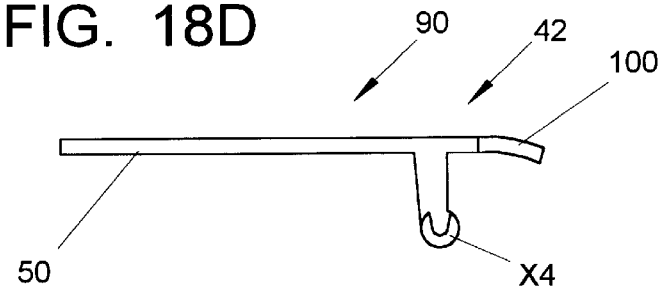
Figure 18E:
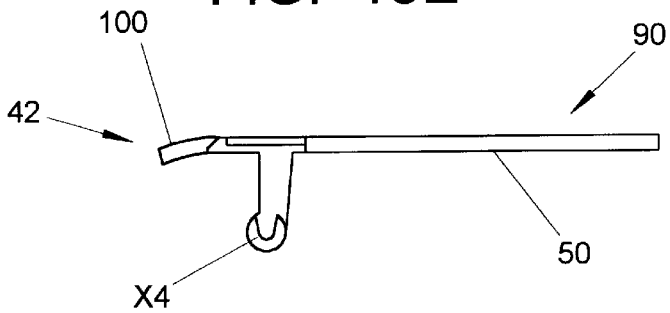

Referring now to FIGS. 17 and 18, depicted therein in detail is the damper member 42. The damper member 42 comprises a central portion 90 that is generally rectangular in overall shape. The central portion 90 is flat and defines the damper surface 50 described above. The damper central portion 90 comprises front and rear side edges 92 and 94 and left and right side edges 96 and 98 and has substantially the same cross-sectional area as the housing passageway 74 described above. A damper plane $p_2$ is defined by the edges 92–98, and a damper axis $x_3$ is defined as a line within the damper plane $p_2$ that is equidistant from the front and back side edges 92 and 94.

The damper member 42 further comprises a control stop 100 that extends from the central portion 90 at the juncture of the rear edge 94 and right side edge 96. The damper member central portion 90 further comprises a plurality of reduced thickness portions separated by strengthening ribs 104. This arrangement of reduced thickness portions 102 and strengthening ribs 104 allows the central portion 90 to be made very light yet sufficiently rigid for the purpose of opening and closing the housing passageway 74.

The damper member 42 further comprises pivot members 106 and 108 that are mounted on struts 110 and 112. The pivot members 106 and 108 are aligned along a cup axis $x_4$. The struts extend from the central portion edges 96 and 98 near the rear edge 94. The pivot axis $x_4$ is thus spaced to the rear of the damper axis $x_3$ and, because of the struts 110 and 112, does not lie in the damper plane $p_2$.

Figure 19:
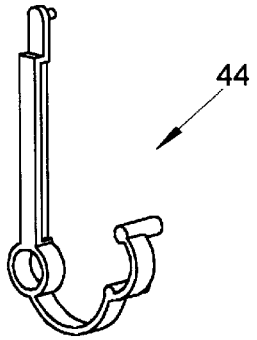
FIG. 19 is a perspective view of a control member used by the vent assembly of FIG. 1.
Figure 20A:
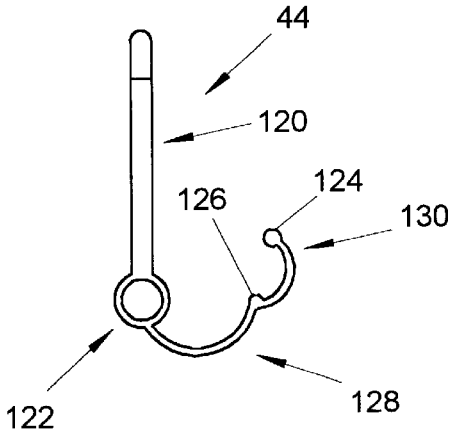
FIGS. 20*a–f* are first side elevation, second side elevation, top plan, bottom plan, front elevation, and rear elevation views of the control member of FIG. 19.
Figure 20B:
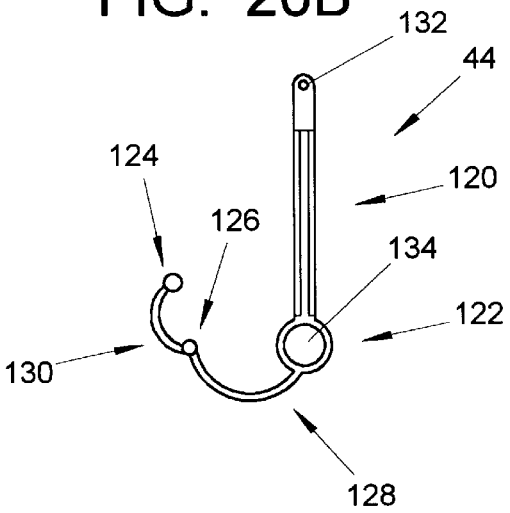
Figure 20C:
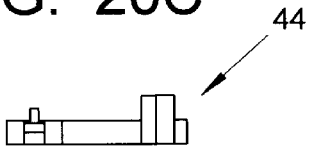
Figure 20D:
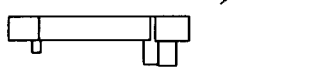
Figure 20E:
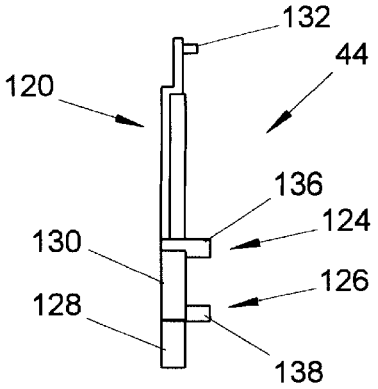
Figure 20F:
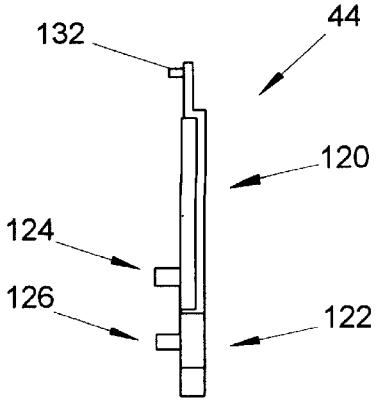

Referring now to FIGS. 19 and 20, depicted therein is the control member 44 briefly discussed above. The control member 44 comprises an elongate extension portion 120, a hinge portion 122, first and second actuator projections 124 and 126, a first connecting portion 128, and a second connecting portion 130.

The extension portion 120 is simply an elongate member that must reach from the hinge portion 122 up through the grate member 40 to the button 46. A button pin 132 positively engages the button 46 such that, as the button slides among the various positions shown in FIG. 5, the actuator portion 122 slides within and rotates relative to the button 46.

The hinge portion 122 is circular and defines a hinge opening 134 sized and dimensioned to receive the control projection 82 of the frame member 38.

The actuator projections 124 and 126 are generally cylindrical and have portions 136 and 138 that, when the control member 44 is installed, extend towards the housing passageway 74. This allows these actuator projections 124 and 126 to engage the stop portion 100 on the damper member 42.

The connecting portions 128 and 130 are sized and dimensioned to allow the actuator projections 124 and 126 to be spaced at the appropriate locations to place the assembly 20 in its various configurations. The first connecting portion 128 is curved so that movement of the control member 44 is not interfered with by the pivot cup 80. The second connecting portion 130 is similarly curved so that it does not interfere with the movement of the damper member 42 between its opened and closed position when the assembly 20 is in its open configuration.

The exact shapes of the connecting portions 128 and 130 are thus not critical as long as they do not interfere with the operation of any other parts of the assembly 20 and locate the actuator projections 124 and 126 as appropriate to perform the functions described above.

Figure 21:
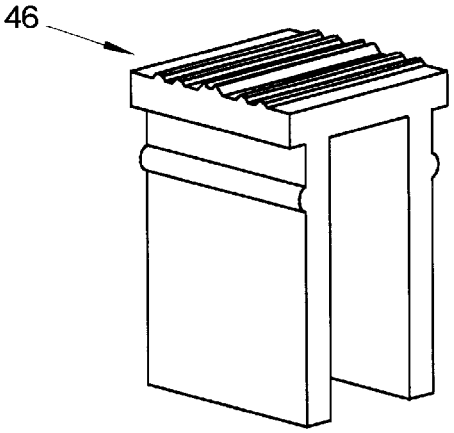
FIG. 21 is a perspective view of a control button of the vent assembly of FIG. 1.
Figure 22A:
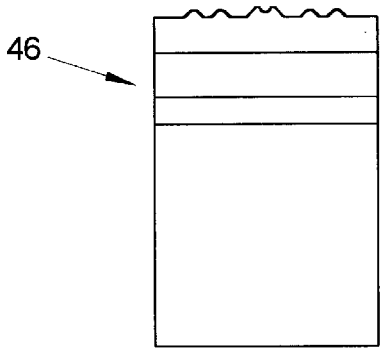
FIGS. 22*a–d* are side elevational, bottom plan, top plan, and front/rear elevational views of the button of FIG. 21.
Figure 22B:
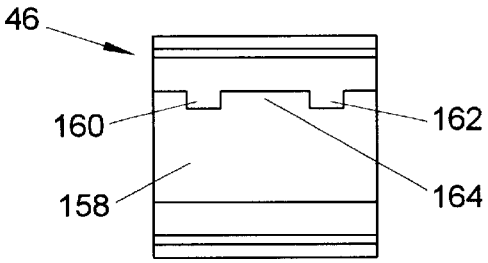
Figure 22C:
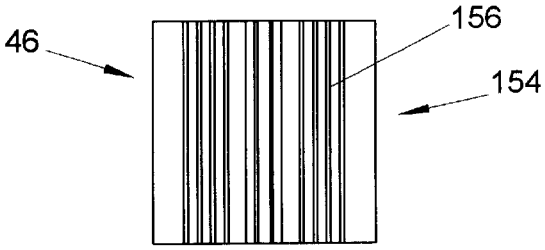
Figure 22D:
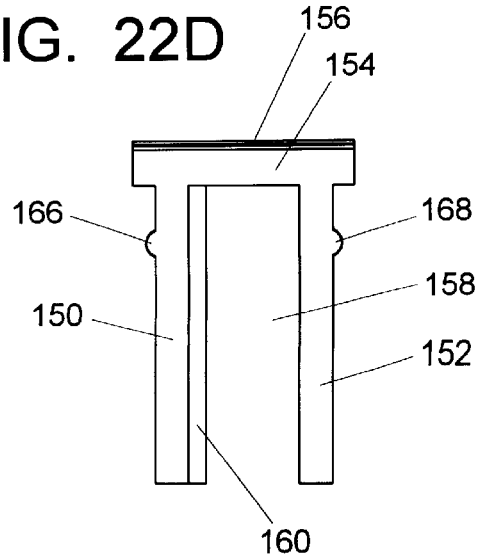

Referring now to FIGS. 21 and 22, depicted therein is the button member 46 described above. This member 46 is generally in the shape of an inverted "U" with first and second leg portions 150 and 152 and a top portion 154. The top portion 154 has a textured upper surface 156. The leg portions 150 and 152 define a gap 158.

Formed on the first leg portion 150 are first and second slot projections 160 and 162 that define an elongate slot 164. This slot 164 receives the button projection 132 on the control member 44 such that movement of the button member 46 is transferred to the upper end of the control member 44.

Also formed on the first and second leg portions 150 and 152 are ridges 166 and 168. These ridges 166 and 168 are elongate and are rounded surface to allow the button member 46 to be attached to the grate member 40 such that the button member 46 slides relative thereto.

Figure 9:
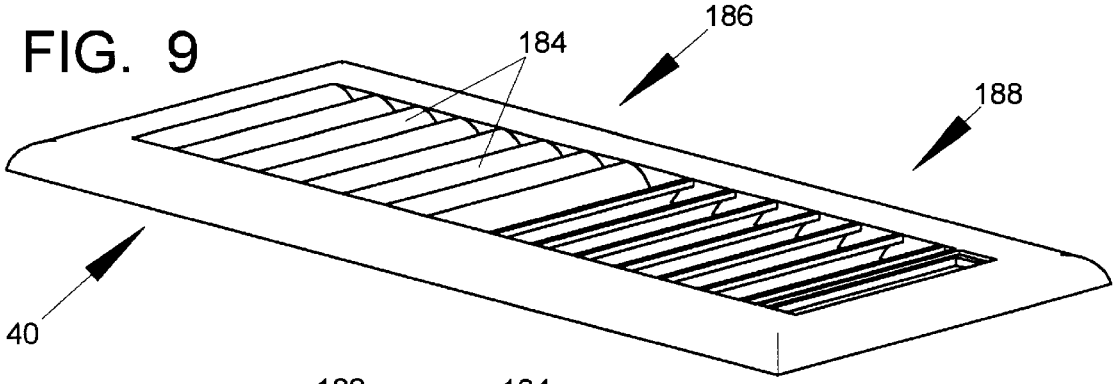
FIG. 9 is a perspective view of the grate member of the air vent assembly of FIG. 1.
Figure 10A:
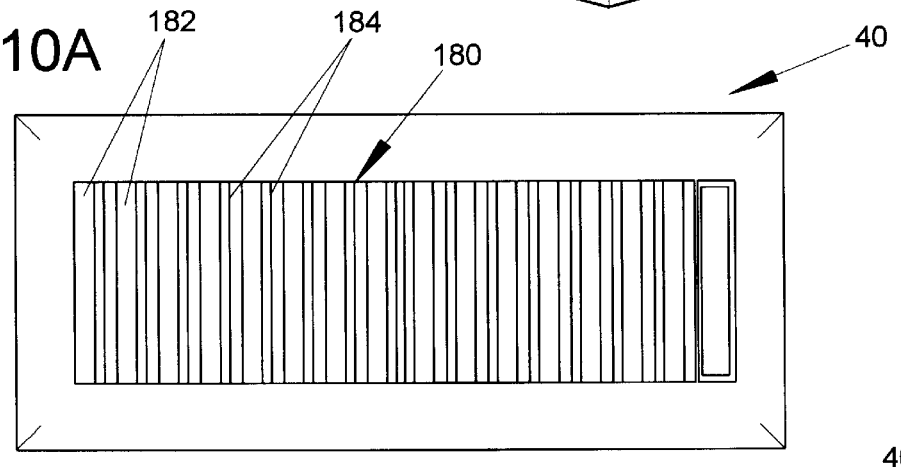
FIGS. 10*a–d* are top plan, side elevation, bottom plan, and end elevation views of the grate member of FIG. 9.
Figure 10B:
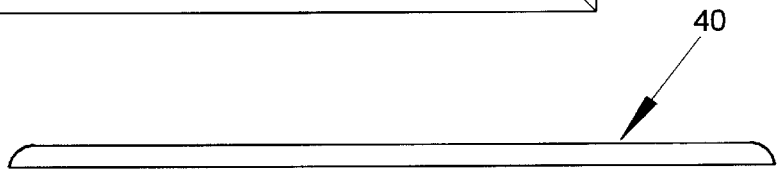
Figure 10C:
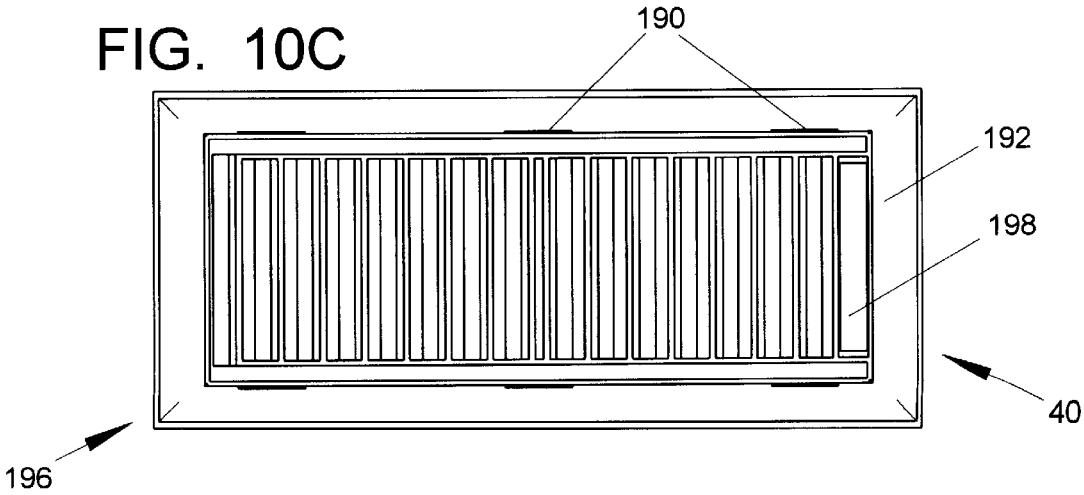
Figure 10D:
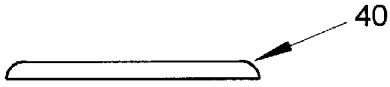

Referring now to FIGS. 9 and 10, depicted therein is the grate member 40 of the present invention. This grate member 40 defines a vent opening 180 that is divided into a number of louver openings 182 by a plurality of fixed louvers 184. As perhaps best shown in FIG. 9, these louvers 184 are arranged in first and second groups 186 and 188. The louvers 184 are slanted or contoured such that forced air passing through the vent opening 180 is directed towards either end of the grate member 40. The louvers 184 also partially cover the opening 180 such that people walking on the floor 28 cannot step into the vent passageway 24.

A series of latch projections 190 are formed on an underside 192 of the grate member 40. These projections 190 engage recesses 194 in the frame member 38 (FIGS. 13A and 13B) to detachably attach the grate member 40 to the frame member 38. A peripheral flange as generally indicated by reference character 196 in FIG. 10*c* extends around the vent opening 180 and, as shown in FIG. 2, rests on the floor surface 30. This allows the grate member 40 to span the upper opening 70 in the frame member 38 with sufficient rigidity to bear the loads of people walking on the grate member 40.

Figure 7:
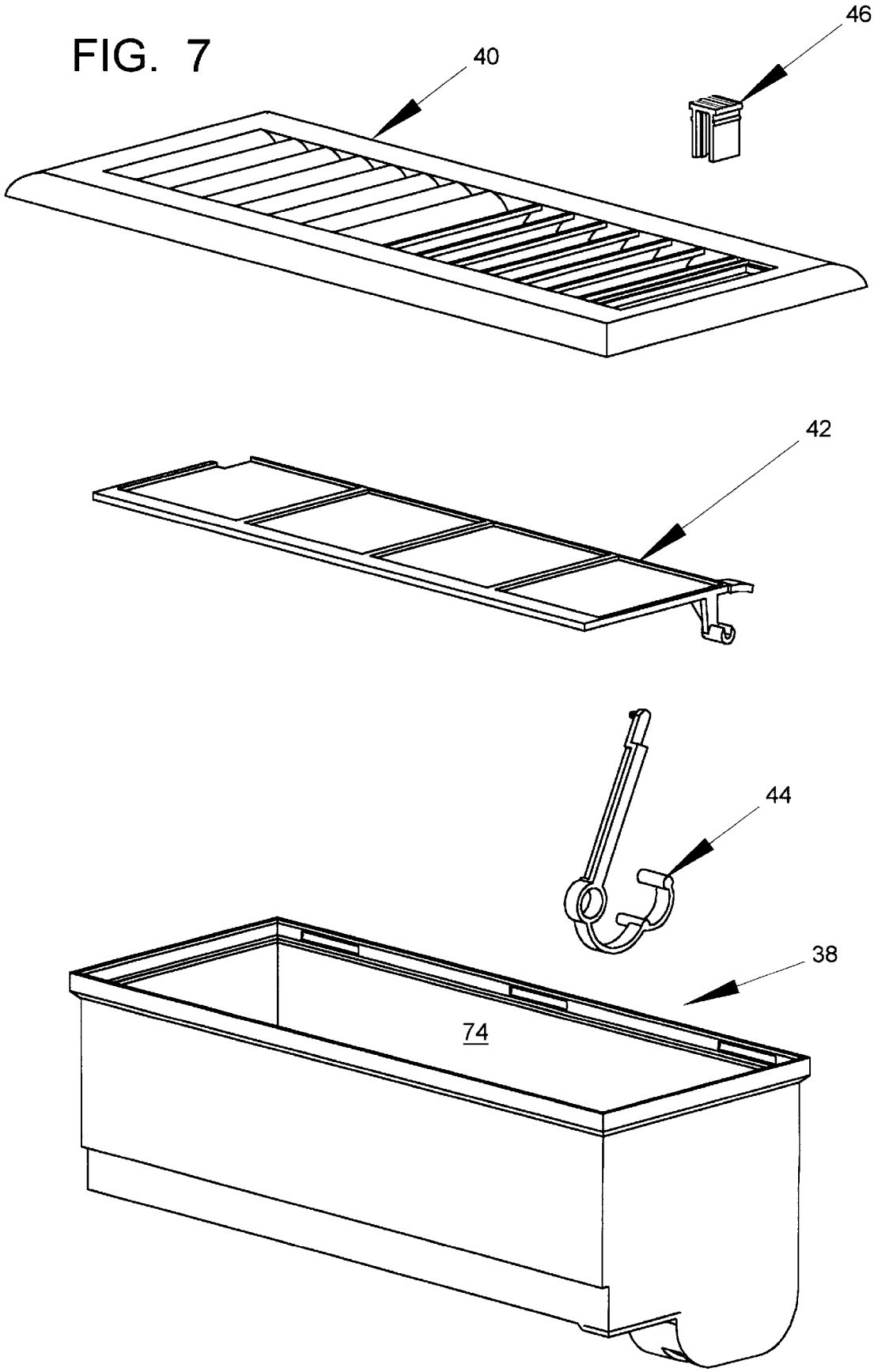
FIG. 7 is an exploded view of the assembly of FIG. 1.
Figure 8:
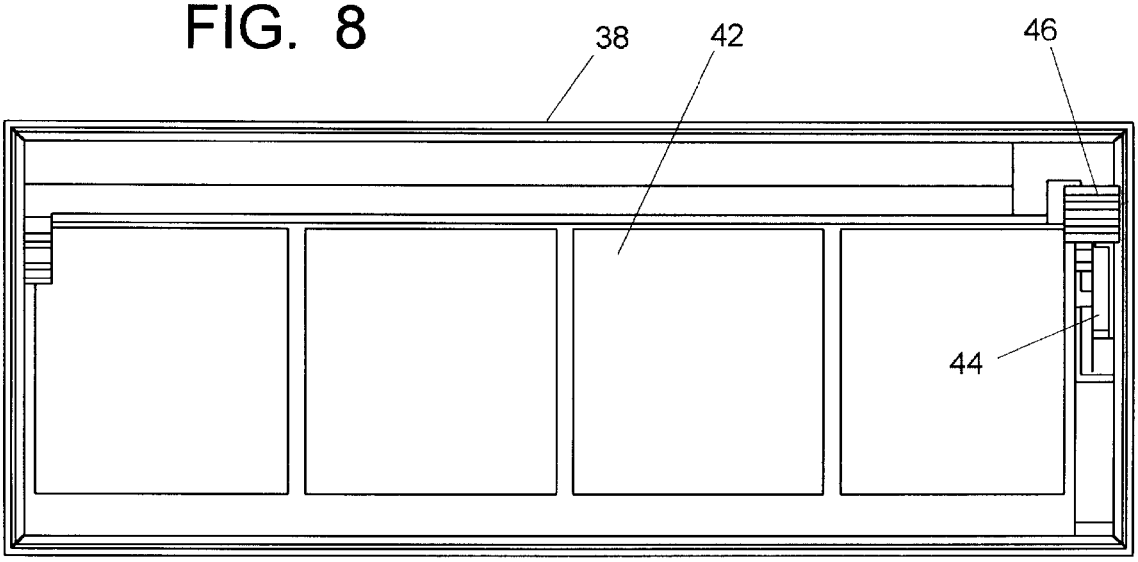
FIG. 8 is a top plan view of the assembly of FIG. 1 with a grate member removed.

Referring now to FIGS. 6–8, the assembly of the frame member 38, grate member 40, damper member 42, control member 44, and button member 46 will be described in detail. Initially, the control member is placed into the housing passageway 74 and moved towards the end wall 66 until the control projection 82 is received within the hinge opening 134 of the control member 44. The control member is then moved such that its extension portion 120 is substantially parallel to the housing reference plane $p_1$. The damper member 42 is then inserted into the housing passageway 74 until the pivot members 106 and 108 are received within the pivot cups 78 and 80. The damper member 42 is then allowed to fall into its closed position.

The grate member 40 is then placed onto the frame member 38 such that the projections 190 engage the recesses 196 as generally shown in FIG. 5C. This secures the grate member 40 onto the frame member 38.

Next, with the extension portion 120 of the control member 44 still generally parallel to the housing reference plane $p_1$, the button member is displace downwardly through the slot 198 in the grate member 40. As the leg portions 150 and 152 of the button member 46 pass through the slot 198, the button projection 132 is received within the slot 164. Applying firm pressure on the button member 46 towards the control member 40 will cause the ribs 166 and 168 on the leg portions 150 and 152 to pass through the slot 198. At this point, a portion of the grate member 40 surrounding the slot 198 is arranged between the ribs 166 and 168 and the upper portion 154 of the button member 146. The ribs 166 and 168 prevent the inadvertent removal of the button member 46 from the grate member 40 but allow the button member to slide within the slot 164.

The air vent assembly 20 is now fully assembled and may be used as described above.

Referring for a moment to FIG. 6, the vent assembly 20 is shown therein in an operative state for purposes of clarity. In particular, the button member 46 is slid completely to the left in FIGS. 6C and 6D, which would normally cause the control member 44 to engage the damper member 42 and hold this damper member 42 in its open position. FIG. 6 is thus for illustrative purposes only to show the attachments of the various parts without illustrating the details of operation of the invention.

Several aspects of the present invention as embodied in the vent assembly 20 should be emphasized. Initially, the foregoing discussion of the operation of the assembly 20 makes it clear that, when the assembly 20 is in its open configuration, the damper member 42 is normally held in its closed position by gravity but is rotated into its open position by the flow of forced air from the vent 22 through the housing passageway 74 and into the interior 26 of the room being serviced by the vent 22.

The location of the cup axis $x_2$ and pivot axis $x_3$ relative to the longitudinal axis $x_1$ of the frame member 38 and center axis $x_3$ of the damper member 42 is important. The drawings employed by the present invention were originally drawn to scale and, with a plastic, injection molded damper member 42, the system 20 is designed such that the presence or absence of forced air will move the damper member 42 between its opened and closed positions as just described. Other configurations of damper members or assemblies may also serve this purpose. With other situations, such as when other materials are used, the dimensions of the various parts must be balanced such that the forced air is able to force the damper member into its open position.

Also, it should be noted that the system described above is optimized for use in a vent that communicates with the room interior through a floor. It is also possible to configure the present invention such that it is arranged in a ceiling vent. Because the assembly 20 would be inverted in this environment, a spring would be required to bias the damper member into its closed position against the force of gravity. This spring should be designed, however, such that forced air will be able to open the damper member as described above.

The vent also will operate when placed in a wall vent with the unit positioned horizontal (90° to wall) with pivot point towards top of unit.

The present invention may thus be embodied in forms other than the preferred embodiment described above. For example, the grate member 40 described above is preferably an injection molded plastic part that may be made in colors and surface textures that match other elements of the room in which it is installed. A variation on the use of single plastic part would be to manufacture this grate member 40 as an assembly comprising two pieces. One of these pieces would likely be a plastic injection molded part that would engage the frame member 38 to attach the grate assembly thereto. The other part might be a cosmetic or decorative piece glued or otherwise attached to the plastic piece that would be more appropriate for matching the room surroundings. For example, this cosmetic or aesthetic piece might be made of wood, brass, or other material that serves an aesthetic purpose. This other part may also be functional in that it contains an air freshener, filter, or other device related to air quality.

The scope of the present invention is thus to be determined by the scope of the claims appended hereto and not the foregoing detailed description.

I claim:

1. An air vent assembly for an air duct mounted in a mounting surface of a room, where forced air flows into an interior of the room from the air duct, comprising:

a housing assembly adapted to be mounted within the air duct, where the housing assembly comprises first, second, third, and fourth walls defining a housing passageway and a housing reference plane, where the housing passageway is adapted to channel air from the air duct to the interior of the room along a housing path and the housing reference plane is equidistant from and parallel to the first and third walls, a perimeter edge adapted to mount substantially flush with the mounting surface, first and second pivot cups formed on the second and fourth walls, respectively, along a cup axis spaced a first predetermined distance from the upper edge and between the housing reference plane and the first wall, and a control projection formed on one of the second and fourth walls;

a damper member comprising a central portion defining a damper surface and first and second pivot portions spaced along a pivot axis, where the first and second pivot members are received by the first and second pivot cups, respectively, and the damper member rotates between a closed position in which the central portion substantially blocks the housing passageway, and an open position in which the damper surface of the central portion deflects the air flowing through the housing passageway such that the air flows into the interior of the room along a flow path that extends at an angle relative to the housing path;

a control member that engages the control projection such that the control member is movable among a plurality of control positions; wherein when the control member is in a first control position, the control member places the air vent assembly in an open configuration in which air flowing through the housing passageway acts on the damper surface and rotates the damper member into the open position against the weight of the central portion of the damper member, and when air does not flow through the housing passageway, the damper member is in the closed position.

2. An air vent assembly as recited in claim 1, in which, when the control member is in a second control position, the control member places the air vent assembly into a locked closed configuration in which the control member engages the damper member to hold the damper member in the closed position.

3. An air vent assembly as recited in claim 1, in which, when the control member is in a third control position, the control member places the air vent assembly into a locked open configuration in which the control member engages the damper member to hold the damper member in the open position.

4. An air vent assembly as recited in claim 2, in which, when the control member is in a third control position, the control member places the air vent assembly into a locked open configuration in which the control member engages the damper member to hold the damper member in the open position.

5. An air vent assembly as recited in claim 1, in which the damper member defines a damper central axis extending through a center of gravity of the damper member, where the damper central axis is parallel to and spaced from the pivot axis.

6. An air vent assembly as recited in claim 5, in which the central portion of the damper member is a flat, rectangular sheet having first, second, third, and fourth edges.

7. An air vent assembly as recited in claim 1, in which:

the control member comprises an upper portion, a pivot portion, and a lower portion; and the control member pivot portion engages the control projection such that the movement of the control member upper portion causes the control member lower portion to rotate about a control axis defined by the control projection.

8. An air vent assembly as recited in claim 7, in which:

the control member lower portion comprises first and second damper projections; and when the control member is in the first control position, the first and second damper projections are located relative to the damper member such that the damper member can rotate between the open and closed positions.

9. An air vent assembly as recited in claim 2, in which:

the control member lower portion comprises first and second damper projections;

when the control member is in the first control position, the first and second damper projections are located relative to the damper member such that the damper member can rotate between the open and closed positions; and when the control member is in the second control position, the first damper projection engages the damper member to hold the damper member in the closed position.

10. An air vent assembly as recited in claim 3, in which:

the control member lower portion comprises first and second damper projections;

when the control member is in the first control position, the first and second damper projections are located relative to the damper member such that the damper member can rotate between the open and closed positions; and when the control member is in the third control position, the first damper projection engages the damper member to hold the damper member in the open position.

11. An air vent assembly as recited in claim 4, in which:

the control member lower portion comprises first and second damper projections;

when the control member is in the first control position, the first and second damper projections are located relative to the damper member such that the damper member can rotate between the open and closed positions;

when the control member is in the second control position, the first damper projection engages the damper member to hold the damper member in the closed position; and when the control member is in the third control position, the first damper projection engages the damper member to hold the damper member in the open position.

12. An air vent assembly for an air duct mounted in a mounting surface of a room, where forced air flows into an interior of the room from the air duct, comprising:

a housing assembly defining a housing passageway and adapted to be mounted within the air duct, where the housing assembly comprises first and second pivot cups arranged along a cup axis that is spaced a first predetermined distance from an upper edge a perimeter edge of the housing assembly;

a damper member comprising a central portion defining a damper surface and first and second pivot portions spaced along a pivot axis, where the first and second pivot members are received by the first and second pivot cups, respectively, and the damper member rotates between a closed position in which the central portion substantially blocks the housing passageway, and an open position in which the damper surface of the central portion deflects the air flowing through the housing passageway such that the air flows into the interior of the room along a flow path that extends at an angle relative to vertical; wherein air flowing through the housing passageway acts on the damper surface and rotates the damper member against gravity into the open position; and when air does not flow through the housing passageway, gravity causes the damper member to rotate into the closed position.

13. An air vent assembly as recited in claim 12, further comprising a control member, where, when the control member is in a first control position, the control member places the air vent assembly into an open configuration in which the control member allows damper member to rotate between the open and closed positions.

14. An air vent assembly as recited in claim 12, further comprising a control member, where, when the control member is in a second control position, the control member places the air vent assembly into a locked closed configuration in which the control member engages the damper member to hold the damper member in the closed position.

15. An air vent assembly as recited in claim 12, in which, when the control member is in a third control position, the control member places the air vent assembly into a locked open configuration in which the control member engages the damper member to hold the damper member in the open position.

16. An air vent assembly as recited in claim 13, further comprising a control member, where:

when the control member is in a first control position, the control member places the air vent assembly into an open configuration in which the control member allows damper member to rotate between the open and closed positions when the control member is in a second control position, the control member places the air vent assembly into a locked closed configuration in which the control member engages the damper member to hold the damper member in the closed position; and when the control member is in a third control position, the control member places the air vent assembly into a locked open configuration in which the control member engages the damper member to hold the damper member in the open position.

17. A method of controlling and directing flow of forced air from an air duct mounted in a floor surface of a room into an interior of the room, comprising the steps of:

providing a housing assembly defining a housing passageway, where the housing assembly comprises first and second pivot cups arranged along a cup axis that is spaced a first predetermined distance below an upper edge of the housing assembly;

mounting the housing assembly into the air duct such that an upper edge of the housing assembly is substantially flush with the floor surface;

providing a damper member comprising a central portion defining a damper surface and first and second pivot portions spaced along a pivot axis;

mounting the damper member within the housing assembly such that the first and second pivot members are received by the first and second pivot cups, respectively, and the pivot axis is spaced below the floor surface; wherein allowing air flowing through the housing passageway to act on the damper surface and rotate the damper member against gravity into an open position in which forced air enters the interior of the room at an angle with respect to vertical; and allowing gravity to act on the damper member to rotate into a closed position in which air is substantially prevented from entering the interior of the room when air does not flow through the housing passageway.

18. A method as recited in claim 17, further comprising the steps of:

providing a control member movable among a plurality of control positions; and placing the air vent assembly into an open configuration by moving the control member into a first control position in which the control member allows the damper member to rotate between the open and closed positions.

19. A method as recited in claim 17, further comprising the steps of:

providing a control member movable among a plurality of control positions; and placing the air vent assembly into an locked closed configuration by moving the control member into a second control position in which the control member engages the damper member to hold the damper member in the closed position.

20. A method as recited in claim 17, further comprising the steps of:

providing a control member movable among a plurality of control positions; and placing the air vent assembly into an locked open configuration by moving the control member into a third control position in which the control member engages the damper member to hold the damper member in the open position.

21. A method as recited in claim 17, further comprising the steps of:

providing a control member movable among a plurality of control positions;

placing the air vent assembly into an open configuration by moving the control member into a first control position in which the control member allows the damper member to rotate between the open and closed positions;

placing the control member into a locked closed configuration by moving the control member into a second control position in which the control member engages the damper member to hold the damper member in the closed position; and placing the control member into a locked open configuration by moving the control member into a third control position in which the control member engages the damper member to hold the damper member in the open position.

* * * * *